US010426013B2

(12) United States Patent
Nakatani et al.

(10) Patent No.: US 10,426,013 B2
(45) Date of Patent: Sep. 24, 2019

(54) GROUND FAULT DETECTION CIRCUIT, ABNORMALITY DETECTION CIRCUIT, LIGHT EMITTING DEVICE, VEHICLE

(71) Applicant: Rohm Co., Ltd., Kyoto (JP)

(72) Inventors: Yoshiyuki Nakatani, Kyoto (JP); Shinsuke Takagimoto, Kyoto (JP)

(73) Assignee: Rohm Co., Ltd., Kyoto (JP)

( * ) Notice: Subject to any disclaimer, the term of this patent is extended or adjusted under 35 U.S.C. 154(b) by 29 days.

(21) Appl. No.: 15/824,315

(22) Filed: Nov. 28, 2017

(65) Prior Publication Data

US 2018/0146523 A1 May 24, 2018

Related U.S. Application Data

(63) Continuation-in-part of application No. 15/581,260, filed on Apr. 28, 2017, now Pat. No. 9,853,439.

(30) Foreign Application Priority Data

May 10, 2016 (JP) ..... 2016-094818

(51) Int. Cl.
*H05B 33/08* (2006.01)

(52) U.S. Cl.
CPC ..... *H05B 33/089* (2013.01); *H05B 33/083* (2013.01)

(58) Field of Classification Search
CPC ..... H02H 3/16; H02H 1/0007; B60Q 1/04; B60Q 1/34; B60Q 1/44; H05B 33/08; H05B 33/083; H05B 33/089
See application file for complete search history.

(56) References Cited

U.S. PATENT DOCUMENTS

2010/0134018 A1* 6/2010 Tziony ..... H05B 33/0815 315/122
2012/0074845 A1 3/2012 Aoki et al.
2013/0313973 A1 11/2013 DeNicholas et al.
2014/0239851 A1 4/2014 Aoki et al.
2015/0163871 A1 6/2015 Takeshi
2016/0121783 A1 5/2016 Takagimoto et al.

FOREIGN PATENT DOCUMENTS

JP 2012-071712 4/2012

OTHER PUBLICATIONS

European Patent Office, Partial European Search Report dated Oct. 5, 2017 in European Patent Application No. 17170438.0.

* cited by examiner

*Primary Examiner* — Jimmy T Vu
(74) *Attorney, Agent, or Firm* — Fish & Richardson P.C.

(57) ABSTRACT

A ground fault detection circuit includes an input portion, and a ground fault determination unit. The input portion inputs an anode voltage of a series connection unit constituted of a plurality of light emission elements. When an anode voltage of the series connection unit input by the input portion is lower than or equal to a predetermined value less than a product of an on-resistance of the short-circuit switch disposed in parallel to each of the light emission elements and current supplied to the series connection unit, the ground fault determination unit determines that a ground fault has occurred without the short-circuit switch in a ground fault path.

2 Claims, 26 Drawing Sheets

GROUND FAULT DETECTION CIRCUIT, ABNORMALITY DETECTION CIRCUIT, LIGHT EMITTING DEVICE, VEHICLE

CROSS-REFERENCE TO RELATED APPLICATIONS

This nonprovisional application claims priority under 35 U.S.C. § 119(a) on Patent Application No. 2016-094818 filed in Japan on May 10, 2016, the entire contents of which are hereby incorporated by reference.

BACKGROUND OF THE INVENTION

Field of the Invention

The present invention relates to a ground fault detection circuit, and an abnormality detection circuit, a light emitting device, and a vehicle each using the ground fault detection circuit. In addition, the present invention relates to a control technique of limp-home control, overheat protection control, or the like, which is used together with lighted element number control technique for controlling the lighted element number of light emission elements in a series connection unit constituted of a plurality of light emission elements.

Description of Related Art

A light emitting device including a series connection unit constituted of a plurality of light emitting diodes is used as a headlight of a vehicle, for example. When it is used as a headlight of a vehicle, in order to realize an adaptive front-lighting system (AFS) or an adaptive driving beam (ADB), it is preferred to adopt a structure in which short-circuit switches are disposed and respectively connected in parallel to light emitting elements of the series connection unit, so that the number of lighted light emitting diodes can be controlled by turning on and off the short-circuit switches.

FIG. 10A is a diagram illustrating a general structure of a light emitting device that includes a series connection unit constituted of a plurality of light emitting diodes and can control the number of lighted light emitting diodes by turning on and off the short-circuit switches.

The light emitting device illustrated in FIG. 10A includes the series connection unit constituted of eight light emitting diodes D1 to D8, a driving circuit 1 that drives the light emitting diodes D1 to D8, and a lighted element number control integrated circuit (IC) 2 that controls the number of lighted light emitting diodes D1 to D8. The lighted element number control IC 2 includes N-channel MOS field-effect transistors Q1 to Q8 that are respectively connected in parallel to the light emitting diodes D1 to D8 so as to function as the short-circuit switches, and a control logic circuit 3 that controls on and off of the transistors Q1 to Q8 in accordance with a lighted element number indicating signal S1 supplied externally. As the lighted element number indicating signal S1 used in this example and other example described later, there are, for example, a signal instructing to turn on the light emitting diode D1 and to turn off the light emitting diodes D2 to D8 (a signal instructing to turn off the transistor Q1 and to turn on the transistors Q2 to Q8), a signal instructing to turn on the light emitting diodes D1 to D8 (a signal instructing to turn off the transistors Q1 to Q8), a signal instructing to turn off the light emitting diodes D1 to D8 (a signal instructing to turn on the transistors Q1 to Q8), and the like.

FIG. 10A illustrates a state where the lighted element number control IC 2 controls the eight light emitting diodes D1 to D8 to be lighted. In this case, all the transistors Q1 to Q8 are turned off, and output current $I_{OUT}$ of the driving circuit 1 flows in the light emitting diodes D1 to D8 so that the light emitting diodes D1 to D8 are lighted.

FIG. 10B illustrates a state where the lighted element number control IC 2 of the light emitting device illustrated in FIG. 10A controls to light only four light emitting diodes D5 to D8. In this case, the transistors Q1 to Q4 are turned on while the transistors Q5 to Q8 are turned off, and the output current $T_{OUT}$ of the driving circuit 1 flows in the transistors Q1 to Q4 and the light emitting diodes D5 to D8 so that the light emitting diodes D5 to D8 are lighted.

FIG. 10C illustrates a state where the lighted element number control IC 2 of the light emitting device illustrated in FIG. 10A controls the number of lighted light emitting diodes to zero. In this case, all the transistors Q1 to Q8 are turned on, and the output current $I_{OUT}$ of the driving circuit 1 flows in the transistors Q1 to Q8 so that the light emitting diodes D1 to D8 are not lighted. Note that the state illustrated in FIG. 10C can be said to be one type of ground fault state because an output terminal of the driving circuit 1 is short-circuited to the ground through the transistors Q1 to Q8, but it is not the state where a ground fault occurs without a short-circuit switch in the ground fault path.

FIG. 10D illustrates a state where a ground fault occurs without a short-circuit switch in the ground fault path in the light emitting device illustrated in FIG. 10A. In FIG. 10D, the control logic circuit 3 controls the transistor Q1 to be off state, and hence the light emitting diode D1 must be intrinsically lighted. However, because of the ground fault without a short-circuit switch in the ground fault path, the light emitting diode D1 is not lighted.

FIG. 10E illustrates a state where a short-circuit abnormality occurs in the light emitting diode D1 in the light emitting device illustrated in FIG. 10A. In FIG. 10E, the control logic circuit 3 controls the transistor Q1 to be off state, and hence the light emitting diode D1 must be intrinsically lighted. However, because of the short-circuit abnormality in the light emitting diode D1, the light emitting diode D1 is not lighted. In addition, in FIG. 10E, the control logic circuit 3 controls the transistors Q2 to Q8 to be on state. Therefore, the output current $I_{OUT}$ of the driving circuit 1 flows in the short-circuited light emitting diode D1 and the transistors Q2 to Q8, and hence the light emitting diodes D1 to D8 are not lighted. Note that the state illustrated in FIG. 10E can be said to be one type of ground fault state because the output terminal of the driving circuit 1 is short-circuited to the ground through the light emitting diode D1 and the transistors Q2 to Q8, but it is not the state where a ground fault occurs without a short-circuit switch in the ground fault path.

In the state illustrated in FIG. 10D, i.e., in the state where a ground fault occurs without a short-circuit switch in the ground fault path, the output current $I_{OUT}$ of the driving circuit 1 continuously and wastefully flows to the ground regardless of the on or off state of the transistors Q2 to Q8. In addition, in the state illustrated in FIG. 10D, i.e., in the state where a ground fault occurs without a short-circuit switch in the ground fault path, current flows in an unexpected ground fault path, and hence there is a risk that a user may touch the ground fault path.

In contrast, in the state illustrated in FIG. 10C or in the state illustrated in FIG. 10E, i.e., in the state where a ground fault occurs with short-circuit switches in the ground fault path, the ground fault disappears if the on or off states of the transistors Q2 to Q8 are changed. Therefore, the wasteful flow of the output current $I_{OUT}$ from the driving circuit 1 to the ground is temporary. In addition, in the state illustrated in FIG. 10C or in the state illustrated in FIG. 10E, i.e., in the state where a ground fault occurs with short-circuit switches in the ground fault path, the ground fault path is along wiring, and hence the user may not touch the ground fault path, which is safe.

Therefore, it is desired that a ground fault with a short-circuit switch in the ground fault path can be discriminated from a ground fault without a short-circuit switch in the ground fault path, and that the ground fault without a short-circuit switch in the ground fault path can be detected.

Here, JP-A-2012-71712 discloses an LED driving device including an LED ground fault detection unit. However, if the LED ground fault detection unit disclosed in JP-A-2012-71712 is simply applied to the light emitting device illustrated in FIG. 10A, there is a problem that all the states illustrated in FIG. 10C to FIG. 10E are detected as a ground fault.

SUMMARY OF THE INVENTION

It is an object of the present invention to provide a ground fault detection circuit, and an abnormality detection circuit, a light emitting device, and a vehicle each using the ground fault detection circuit, which can detect a ground fault without a short-circuit switch in the ground fault path by discriminating it from a ground fault with a short-circuit switch in the ground fault path. In addition, it is an object of the present invention to provide a control technique of limp-home control, overheat protection control, or the like, which is used together with lighted element number control technique for controlling the lighted element number of light emission elements in a series connection unit constituted of a plurality of light emission elements.

One example of a ground fault detection circuit disclosed in this specification detects a ground fault of a light emitting device including a series connection unit constituted of N light emitting elements (N is a natural number equal to or larger than two), a light emitting element driving circuit having an output terminal connected to an anode of the series connection unit, N short-circuit switches respectively connected in parallel to the light emitting elements, and a switch control unit arranged to control on and off of the short-circuit switches. The ground fault detection circuit includes an input portion to which an anode voltage of the series connection unit is input, and a ground fault determination unit arranged to determine that a ground fault has occurred without a short-circuit switch in the ground fault path, when the anode voltage of the series connection unit input through the input portion is equal to or smaller than a predetermined value that is smaller than the product of an on-resistance of one of the short-circuit switches and output current of the light emitting element driving circuit.

Another example of the ground fault detection circuit disclosed in this specification detects a ground fault of a light emitting device including a series connection unit constituted of N light emitting elements (N is a natural number equal to or larger than two), a light emitting element driving circuit having an output terminal connected to an anode of the series connection unit, N short-circuit switches respectively connected in parallel to the light emitting elements, and a switch control unit arranged to control on and off of the short-circuit switches. The ground fault detection circuit includes N short-circuit detection circuits arranged respectively to detect short-circuits in the light emitting elements, and a ground fault determination unit arranged to determine that a ground fault has occurred without a short-circuit switch in the ground fault path, if all the N short-circuit detection circuits detect that short-circuits have occurred in all the N light emitting elements when the switch control unit makes all the N short-circuit switches be in off state.

An example of an abnormality detection circuit disclosed in this specification includes the ground fault detection circuit of the one example described above, N short-circuit detection circuits arranged respectively to detect short-circuits in the light emitting elements, and a short-circuit determination unit arranged to determine that a short circuit has occurred, if at least one of the short-circuit detection circuits detects that a short circuit has occurred in the light emitting element when the switch control unit makes all the N short-circuit switches be in off state.

Another example of the abnormality detection circuit disclosed in this specification includes the ground fault detection circuit of the another example, and a short-circuit determination unit arranged to determine that a short circuit has occurred, if at least one of the short-circuit detection circuits detects that a short circuit has occurred in the light emitting element when the switch control unit makes all the N short-circuit switches be in off state.

A light emitting device disclosed in this specification includes the ground fault detection circuit having any one of the structures described above or the abnormality detection circuit having any one of the structures described above, a series connection unit constituted of N light emitting elements (N is a natural number equal to or larger than two), a light emitting element driving circuit having an output terminal connected to an anode of the series connection unit, N short-circuit switches respectively connected in parallel to the light emitting elements, and a switch control unit arranged to control on and off of the short-circuit switches.

A vehicle disclosed in this specification includes the light emitting device having the structure described above.

The meanings and effects of the present invention will become more apparent from the description of an embodiment given below. However, the embodiment described below is merely an embodiment of the present invention, and meanings of the present invention and terms of structural components are not limited to those described in the following embodiment.

DETAILED DESCRIPTION OF THE PREFERRED EMBODIMENTS

First Structural Example

Figure 1:
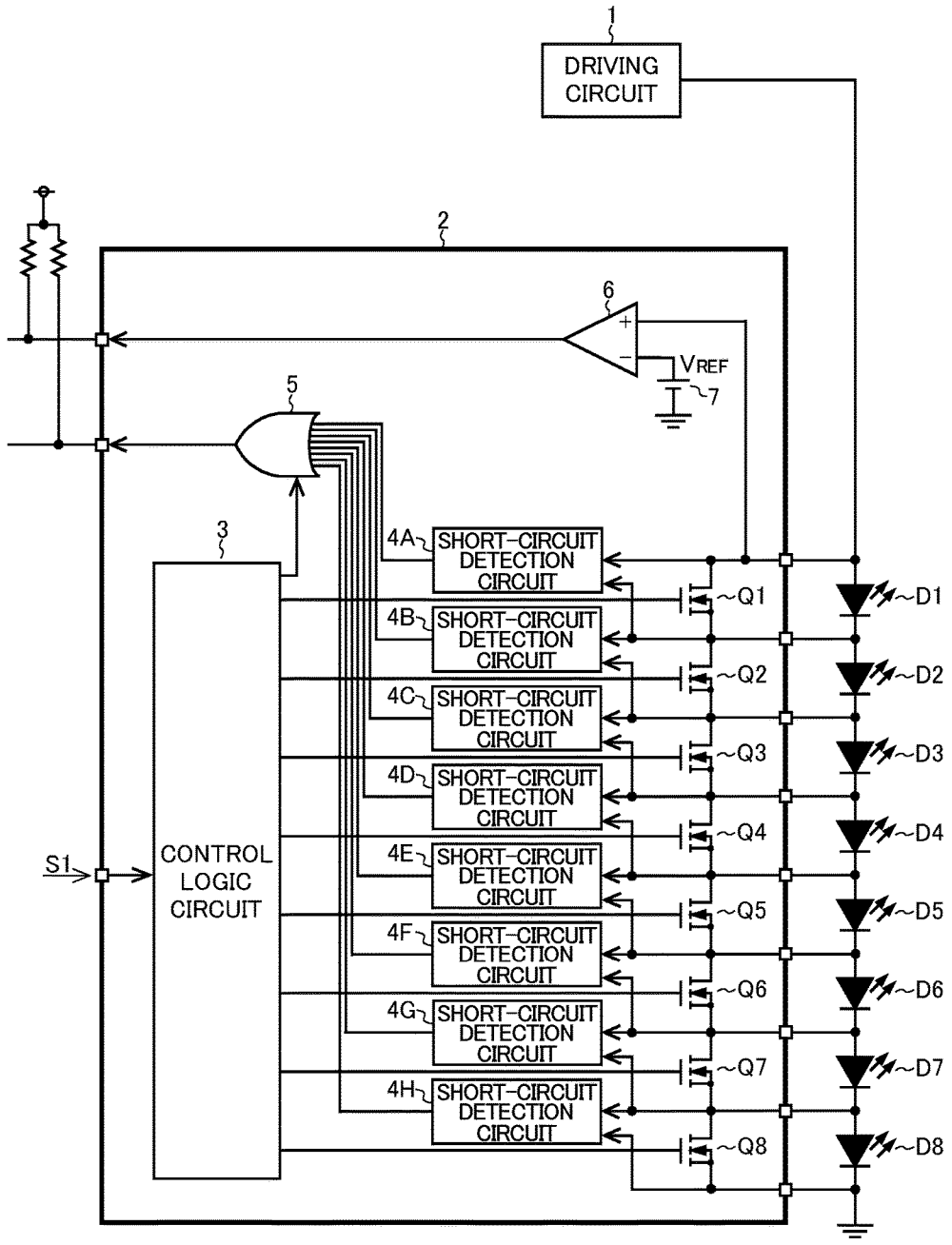
FIG. 1 is a diagram illustrating a first structural example of a light emitting device.

FIG. 1 is a diagram illustrating a first structural example of a light emitting device. The light emitting device illustrated in FIG. 1 includes a series connection unit constituted of eight light emitting diodes D1 to D8, a driving circuit 1 that drives the light emitting diodes D1 to D8, and a lighted element number control IC (integrated circuit) 2 that controls the number of lighted elements in the light emitting diodes D1 to D8. The lighted element number control IC 2 includes N-channel MOS field-effect transistors Q1 to Q8, a control logic circuit 3 that controls on and off of the transistors Q1 to Q8 in accordance with a lighted element number indicating signal S1 supplied externally, short-circuit detection circuits 4A to 4H, an OR gate 5, a comparator 6, and a reference voltage source 7. Note that, in the structural example of FIG. 1, the number of the light emitting diodes, the number of the transistors as short-circuit switches, and the number of the short-circuit detection circuits are each eight, but the number may be two or more without limiting to eight.

The driving circuit 1 is, for example, a series regulator that supplies a constant current to a load connected to its output terminal, a switching regulator that supplies a pulse width modulated (PWM) current having a predetermined on-duty to a load connected to its output terminal, or the like.

The anode of the series connection unit constituted of the light emitting diodes D1 to D8 (anode of the light emitting diode D1) is connected to the output terminal of the driving circuit 1. The cathode of the series connection unit constituted of the light emitting diodes D1 to D8 (cathode of the light emitting diode D8) is connected to the around.

The both ends of the series connection unit constituted of the light emitting diodes D1 to D8 and each connection node between the light emitting diodes are connected to the lighted element number control IC 2, so that a transistor Qk (k is a natural number equal to or smaller than eight) is connected in parallel to a light emitting diode Dk (k is a natural number equal to or smaller than eight). In this way, the transistor Qk is the short-circuit switch for the light emitting diode Dk. In addition, an external terminal of the lighted element number control IC 2, to which the drain of the transistor Q1 is connected, is an input portion to which an anode voltage of the series connection unit constituted of the light emitting diodes D1 to D8 (anode voltage of the light emitting diode D1) is input.

The control logic circuit 3 controls each gate-source voltage of the transistors Q1 to Q8 so as to control on and off of the transistors Q1 to Q8. Therefore, although not illustrated in FIG. 1, in reality, not only the gates of the transistors Q1 to Q8 but also sources of the transistors Q1 to Q8 are connected to the control logic circuit 3.

The short-circuit detection circuit 4A checks whether or not an anode-cathode voltage of the light emitting diode D1 is substantially zero when the transistor Q1 is in off state. If it is substantially zero, the short-circuit detection circuit 4A detects a short circuit in the light emitting diode D1 so as to output a low level signal. If a short circuit in the light emitting diode D1 is not detected, the short-circuit detection circuit 4A outputs a high level signal. Therefore, although not illustrated in FIG. 1, in reality, the control logic circuit 3 sends a signal for notifying a state of the transistor Q1 to the short-circuit detection circuit 4A. In the same manner, the short-circuit detection circuits 4B to 4H detect short-circuits in the light emitting diodes D2 to D8, respectively.

The OR gate 5 takes a logical OR of the signals supplied from the short-circuit detection circuits 4A to 4H, in which high level is "0" while low level is "1". Further, if at least one of the signals supplied from the short-circuit detection circuits 4A to 4H is low level when the transistors Q1 to Q8 are in off state, the OR gate 5 outputs a low level signal indicating that a short circuit has been determined to occur. Therefore, when the transistors Q1 to Q8 are off state, the control logic circuit 3 enables the OR gate 5 to perform the logical OR operation. When at least one of the transistors Q1 to Q8 is in on state, the control logic circuit 3 disables the OR gate 5 to perform the logical OR operation, and makes the output of the OR gate 5 be in an open state. In order that the external terminal of the lighted element number control IC 2, to which the output of the OR gate 5 is connected, becomes high level when the output of the OR gate 5 is in open state, a pull-up resistor is connected to the external terminal of the lighted element number control IC 2 to which the output of the OR gate 5 is connected.

The comparator 6 compares the anode voltage of the series connection unit constituted of the light emitting diodes D1 to D8 (anode voltage of the light emitting diode D1) with a reference voltage $V_{REF}$ generated by the reference voltage source 7. If the anode voltage of the light emitting diode D1 is higher than the reference voltage $V_{REF}$, the comparator 6 outputs a high level signal. If the anode voltage of the light emitting diode D1 is equal to or lower than the reference voltage $V_{REF}$, the comparator 6 outputs a low level signal. The reference voltage $V_{REF}$ is set to be lower than the product of an on-resistance of one of the transistors Q1 to Q8 (smallest on-resistance if the transistors Q1 to Q8 have different on-resistances) and output current of the driving circuit 1 (average value of the PWM current if the output current is the PWM current).

Figure 10A:
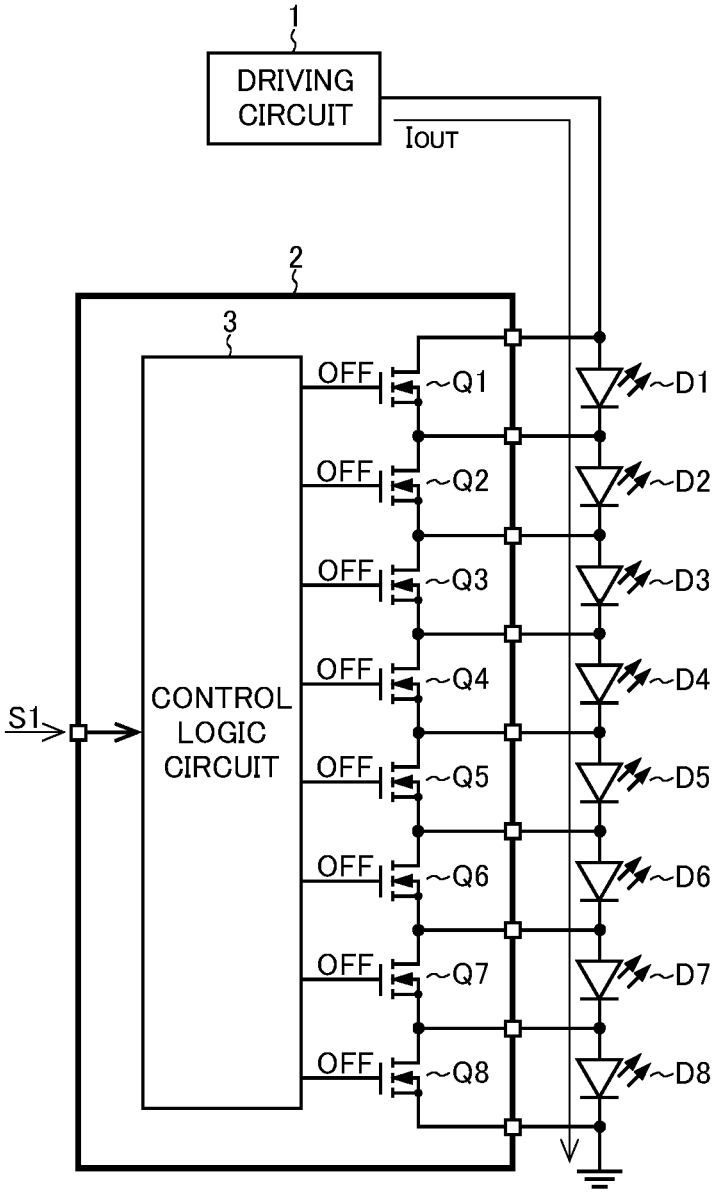
RELATED ART FIG. 10A
FIG. 10A is a diagram illustrating a general structural example of the light emitting device.
Figure 10B:
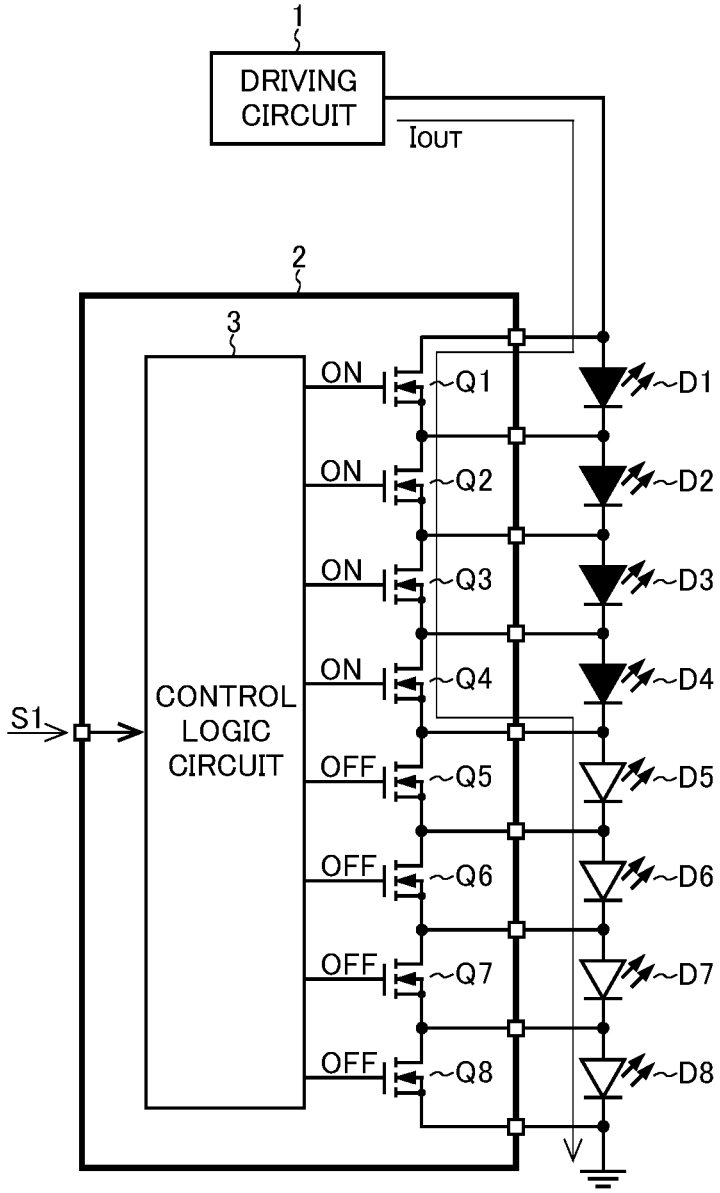
RELATED ART FIG. 10B
FIG. 10B is a diagram illustrating a state where the light emitting device illustrated in FIG. 10A is partially lighted.

When at least one of the light emitting diodes D1 to D8 is lighted (see FIGS. 10A and 10B), because the forward voltage of the lighted light emitting diode is higher than the product of the on-resistance of one of the transistors Q1 to Q8 and the output current of the driving circuit 1, the output signal of the comparator 6 becomes high level.

Figure 10C:
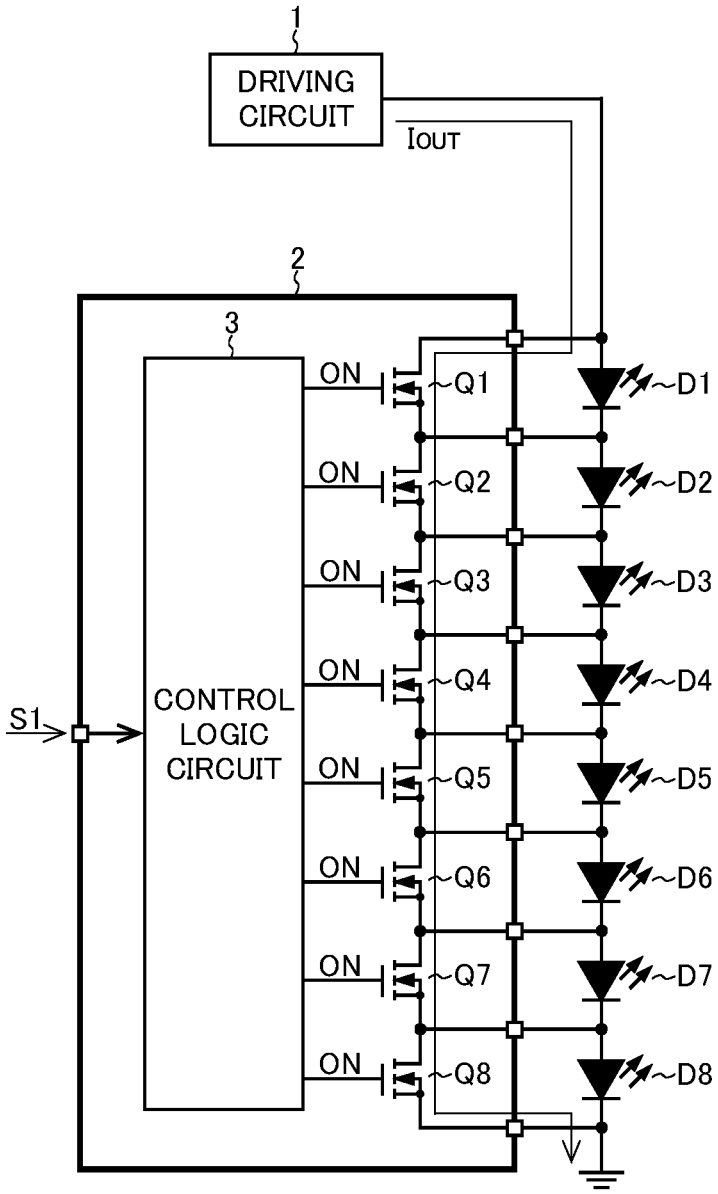
RELATED ART FIG. 10C
FIG. 10C is a diagram illustrating a state where the number of lighted elements in the light emitting device illustrated in FIG. 10A is controlled to be zero.
Figure 10D:
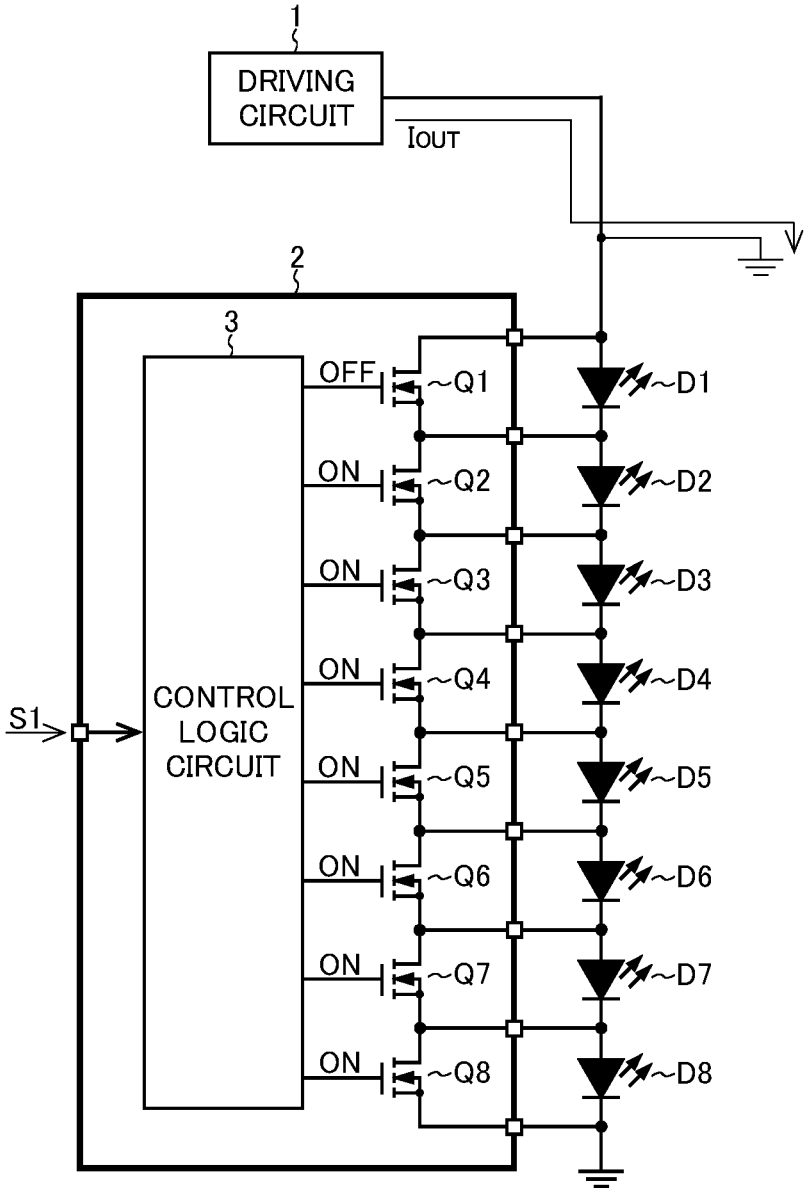
RELATED ART FIG. 10D
FIG. 10D is a diagram illustrating a state where a ground fault occurs without a short-circuit switch in the ground fault path in the light emitting device illustrated in FIG. 10A.
Figure 10E:
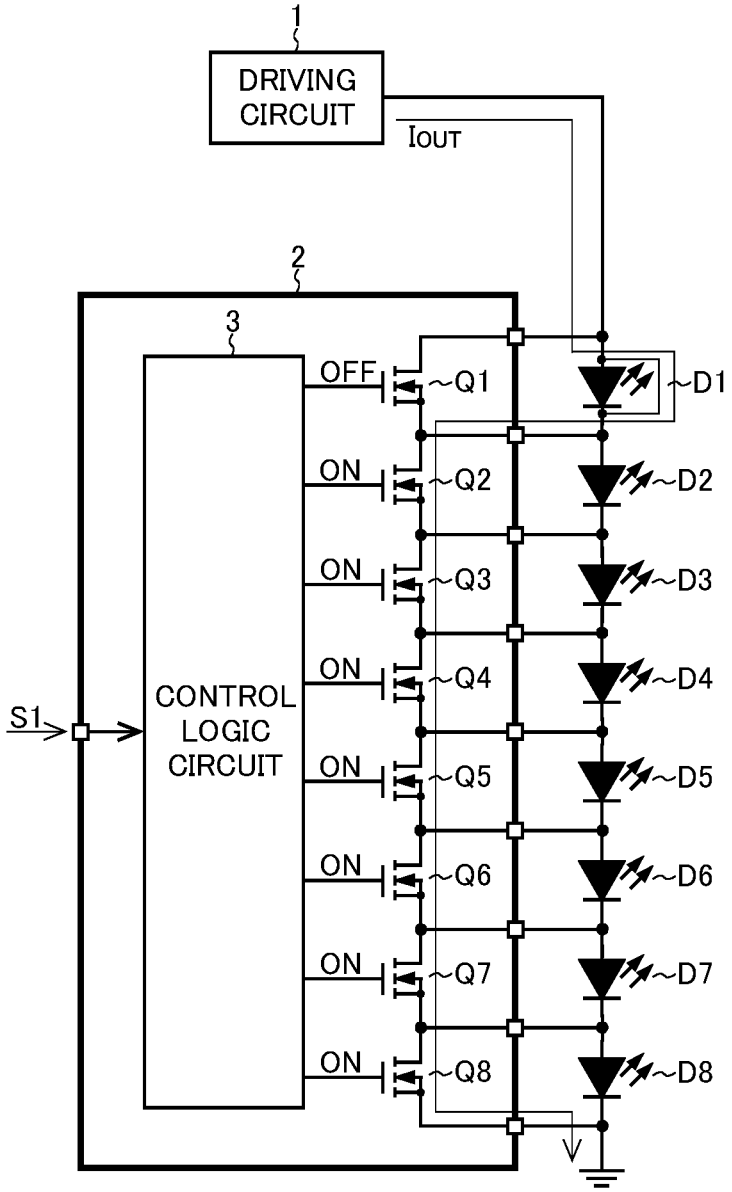
RELATED ART FIG. 10E
FIG. 10E is a diagram illustrating a state where a short-circuit abnormality occurs in the light emitting device illustrated in FIG. 10A.

In addition, when the light emitting diodes D1 to D8 are not lighted and current is flowing in at least one of the transistors Q1 to Q8 (see FIGS. 10C and 10E), because the anode voltage of the light emitting diode D1 is higher than the product of the on-resistance of one of the transistors Q1 to Q8 and the output current of the driving circuit 1, the output signal of the comparator 6 becomes high level. In other words, when a ground fault occurs with one of the transistors Q1 to Q8 in the ground fault path, the output signal of the comparator 6 becomes high level.

On the other hand, when a ground fault occurs without any of the transistors Q1 to Q8 in the ground fault path (see FIG. 10D), because current does not flow in any of the transistors Q1 to Q8, the output signal of the comparator 6 becomes low level. In other words, when a ground fault occurs without any of the transistors Q1 to Q8 in the ground fault path, the output signal of the comparator 6 becomes low level.

In this way, the comparator 6 can detect a ground fault without any of the transistors Q1 to Q8 in the ground fault path by discriminating it from a ground fault with one of the transistors Q1 to Q8 in the ground fault path, and outputs a low level signal indicating that a ground fault without any of the transistors Q1 to Q8 in the ground fault path is detected when it is detected.

There is no particular limitation about how to use the low level signal that can be output from the OR gate 5 and the low level signal that can be output from the comparator 6. However, in consideration that current flows in an unexpected ground fault path in a state where a ground fault occurs without any of the transistors Q1 to Q8 in the ground fault path, and hence there is a risk that the user may touch the ground fault path, it is preferred to enhance safety measures more in the case where the comparator 6 outputs the low level signal than in the case where the OR gate 5 outputs the low level signal. For example, it is considered that when the OR gate 5 outputs the low level signal, a notifying unit (not shown) notifies the user that a short circuit has occurred while continuing operation of the driving circuit 1, but in contrast, when the comparator 6 outputs the low level signal, the notifying unit (not shown) notifies the user that a ground fault without any of the transistors Q1 to Q8 in the ground fault path has occurred while stopping operation of the driving circuit 1.

Second Structural Example

Figure 2:
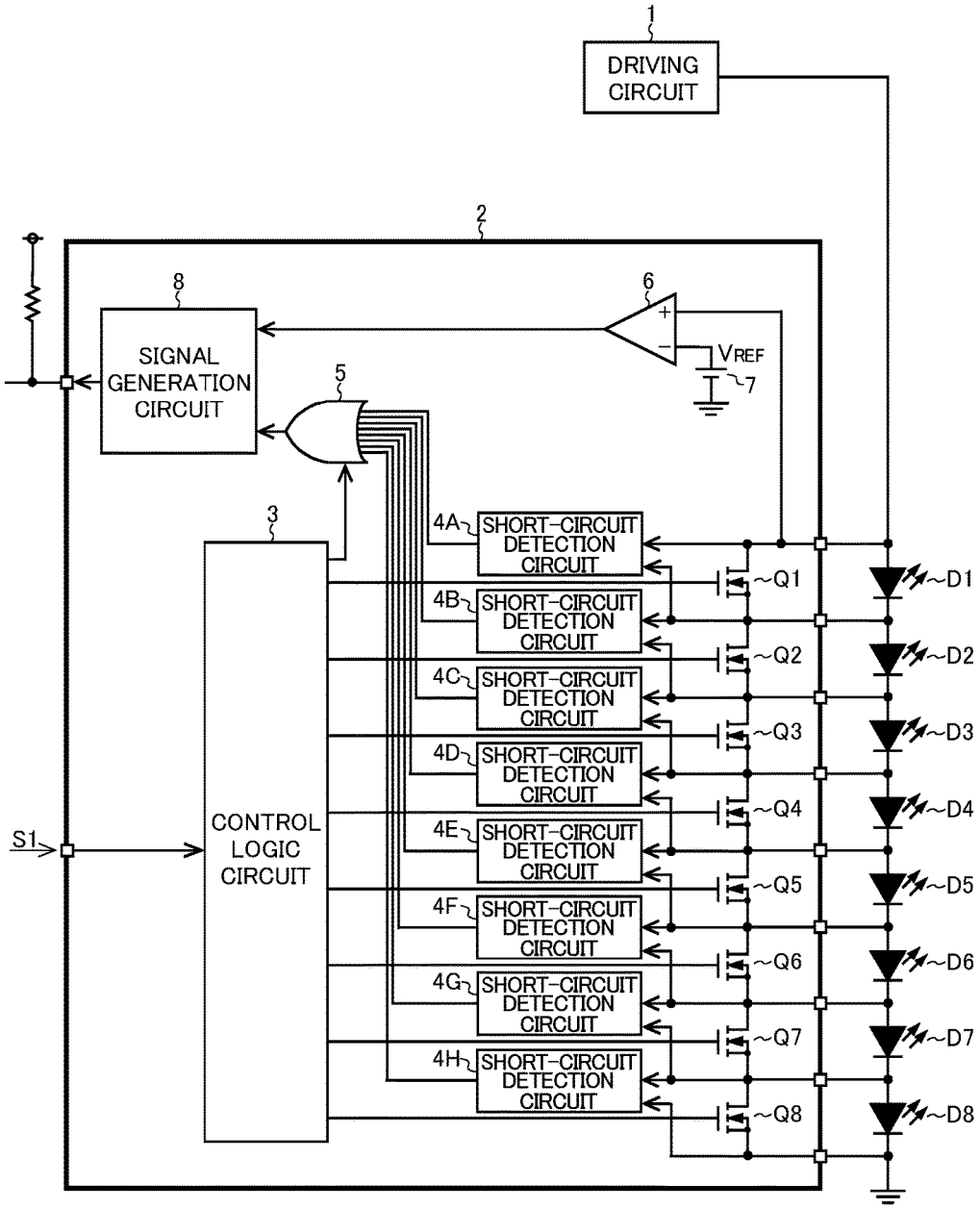
FIG. 2 is a diagram illustrating a second structural example of the light emitting device.

FIG. 2 is a diagram illustrating a second structural example of the light emitting device. The light emitting device illustrated in FIG. 2 has a structure in which a signal generation circuit 8 is added to the light emitting device illustrated in FIG. 1, and the signal generation circuit 8 is disposed inside the lighted element number control IC 2.

The signal generation circuit 8 generates an abnormality detection signal based on the output signal of the comparator 6 and the output signal of the OR gate 5, and externally outputs the abnormality detection signal.

When the output signal of the comparator 6 is a low level signal (indicating that a ground fault without any of the transistors Q1 to Q8 in the ground fault path is detected), the signal generation circuit 8 makes the abnormality detection signal be a signal having a first waveform (e.g. a low level signal).

When the output signal of the comparator 6 is not a low level signal (indicating that a ground fault without any of the transistors Q1 to Q8 in the ground fault path is detected) and the output signal of the OR gate 5 is a low level signal (indicating that a short circuit has occurred), the signal generation circuit 8 makes the abnormality detection signal be a signal having a second waveform different from the first waveform (e.g. a pulse signal).

The light emitting device illustrated in FIG. 2 achieves the same effect as the light emitting device illustrated in FIG. 1. In addition, the light emitting device illustrated in FIG. 2 can eliminate one external terminal of the lighted element number control IC 2 from the light emitting device illustrated in FIG. 1, because the signal generation circuit 8 generates one abnormality detection signal from the output signal of the comparator 6 and the output signal of the OR gate 5.

Third Structural Example

Figure 3:
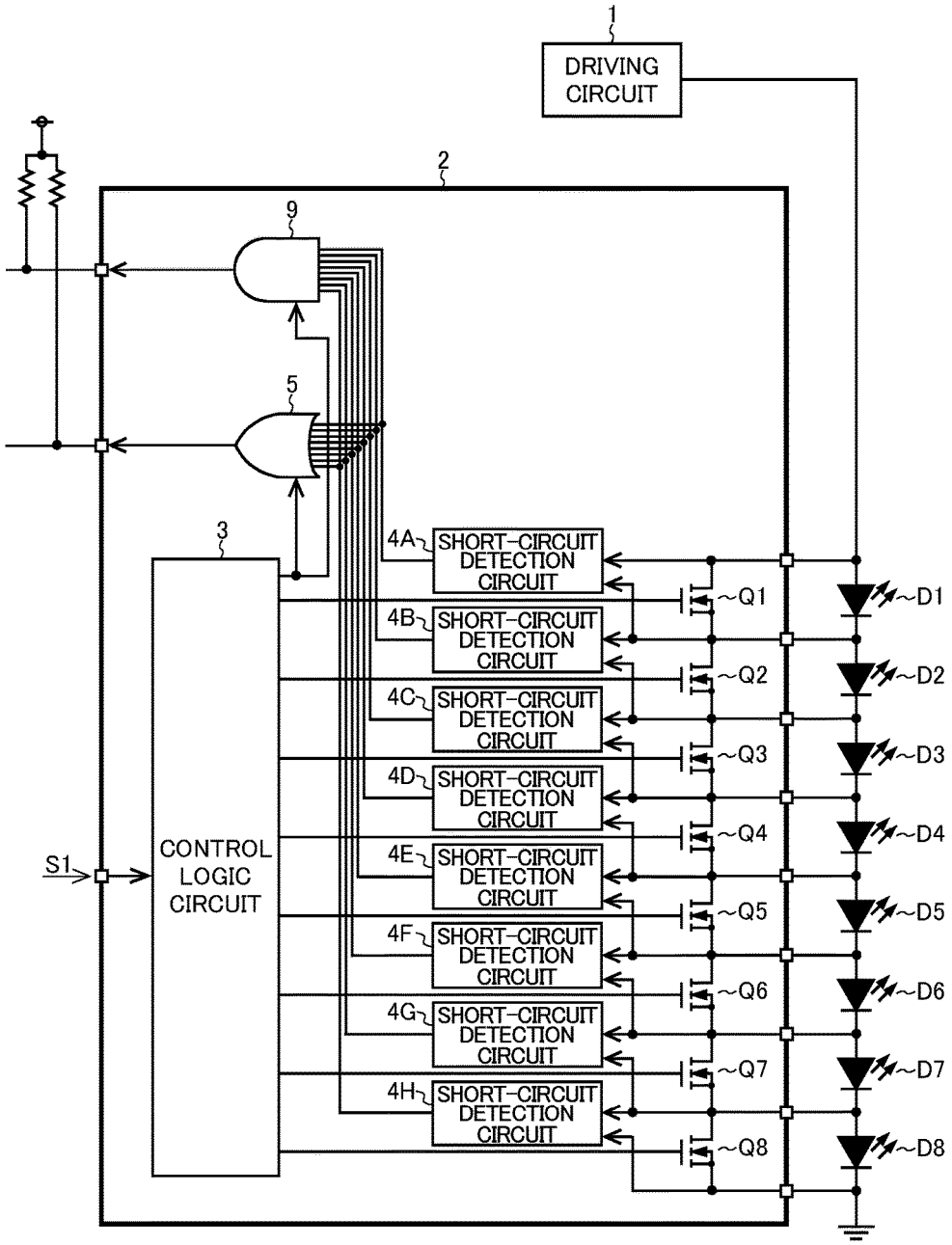
FIG. 3 is a diagram illustrating a third structural example of the light emitting device.

FIG. 3 is a diagram illustrating a third structural example of the light emitting device. The light emitting device illustrated in FIG. 3 has a structure in which the comparator 6 and the reference voltage source 7 are eliminated from the light emitting device illustrated in FIG. 1 while an AND gate 9 is added to the same, and the AND gate 9 is disposed inside the lighted element number control IC 2.

The AND gate 9 takes a logical AND of the signals supplied from the short-circuit detection circuits 4A to 4H, in which high level is "0" while low level is "1". Further, if all the signals supplied from the short-circuit detection circuits 4A to 4H are low level when the transistors Q1 to Q8 are in off state, the AND gate 9 outputs a low level signal. Therefore, when the transistors Q1 to Q8 are in off state, the control logic circuit 3 enables the AND gate 9 to perform the logical AND operation. When at least one of the transistors Q1 to Q8 is in on state, the control logic circuit 3 disables the AND gate 9 to perform the logical AND operation, and makes the output of the AND gate 9 be in an open state. In order that the external terminal of the lighted element number control IC 2, to which the output of the AND gate 9 is connected, becomes high level when the output of the OR gate 5 is in an open state, a pull-up resistor is connected to the external terminal of the lighted element number control IC 2 to which the output of the AND gate 9 is connected.

When at least one of the light emitting diodes D1 to D8 is lighted (see FIGS. 10A and 10B), because the lighted light emitting diode is not short-circuited, the output signal of the AND gate 9 becomes high level.

In addition, when the light emitting diodes D1 to D8 are not lighted and current flows in at least one of the transistors Q1 to Q8 (see FIGS. 10C and 10E), because at least one the transistors Q1 to Q8 is in on state, the AND gate 9 does not perform the logical AND operation so that the output of the AND gate 9 becomes an open state.

On the other hand, when a ground fault occurs without any of the transistors Q1 to Q8 in the ground fault path (see FIG. 10D), all the light emitting diodes D1 to D8 are short-circuited. Therefore, when all the transistors Q1 to Q8 are in the off state, the AND gate 9 performs the logical AND operation, and the output signal of the AND gate 9 becomes low level. When at least one of the transistors Q1 to Q8 is in the on state, the AND gate 9 does not perform the logical AND operation, and the output of the AND gate 9 becomes the open state.

In this way, the AND gate 9 can detect a ground fault without any of the transistors Q1 to Q8 in the ground fault path by discriminating it from a ground fault with one of the transistors Q1 to Q8 in the ground fault path, and outputs a low level signal indicating that a ground fault without any of the transistors Q1 to Q8 in the ground fault path is detected when it is detected. In other words, the light emitting device illustrated in FIG. 3 achieves the same effect as the light emitting device illustrated in FIG. 1.

Fourth Structural Example

Figure 4:
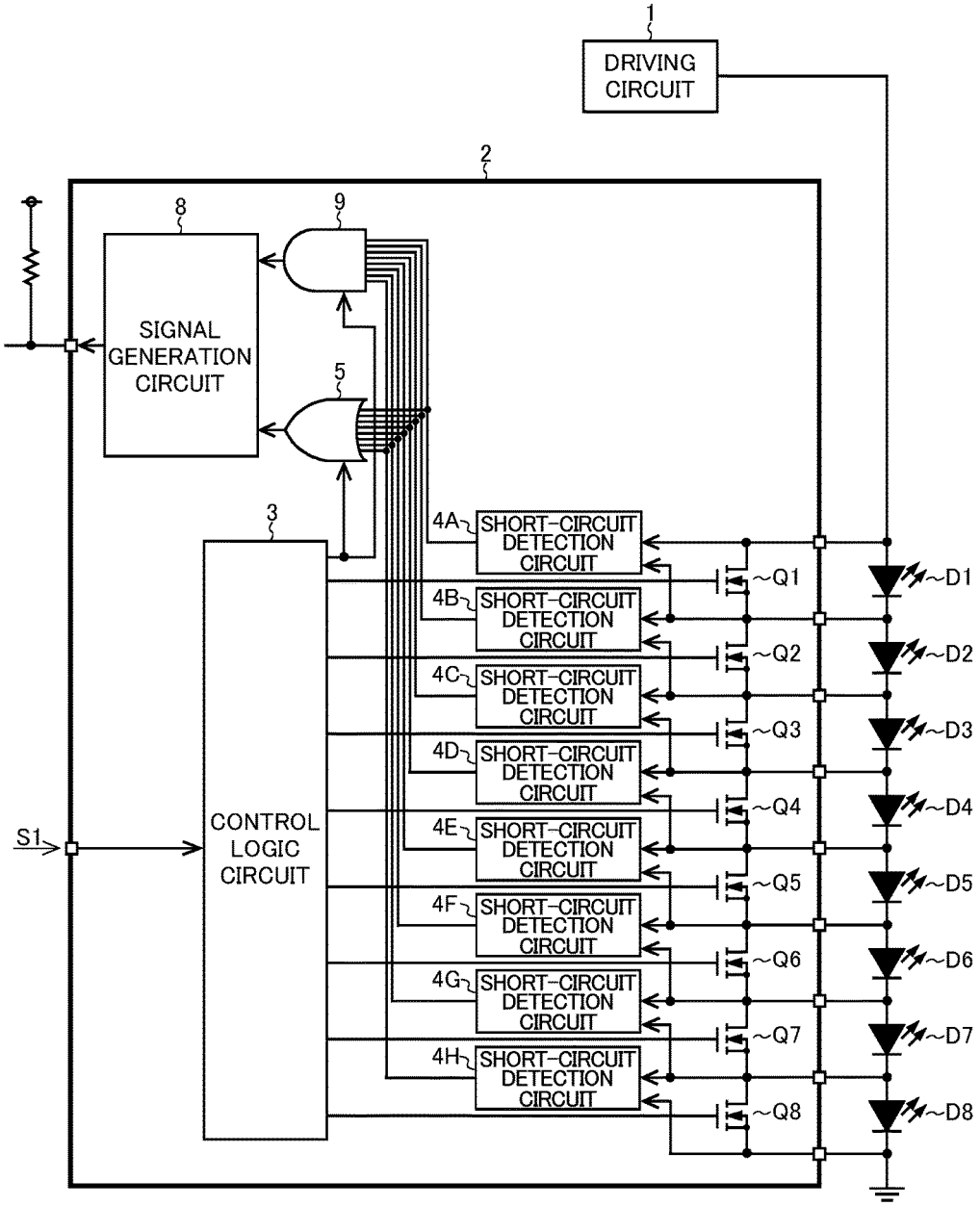
FIG. 4 is a diagram illustrating a fourth structural example of the light emitting device.

FIG. 4 is a diagram illustrating a fourth structural example of the light emitting device. The light emitting device illustrated in FIG. 4 has a structure in which the signal generation circuit 8 is added to the light emitting device illustrated in FIG. 3, and the signal generation circuit 8 is disposed inside the lighted element number control IC 2.

The signal generation circuit 8 generates an abnormality detection signal based on the output signal of the AND gate 9 and the output signal of the OR gate 5, and externally outputs the abnormality detection signal.

When the output signal of the AND gate 9 is a low level signal (indicating that a ground fault without any of the transistors Q1 to Q8 in the ground fault path is detected), the signal generation circuit 8 makes the abnormality detection signal be a signal having a first waveform (e.g. a low level signal).

When the output signal of the AND gate 9 is not a low level signal (indicating that a ground fault without any of the transistors Q1 to Q8 in the ground fault path is detected) and the output signal of the OR gate 5 is a low level signal (indicating that a short circuit has occurred), the signal generation circuit 8 makes the abnormality detection signal be a signal having a second waveform different from the first waveform (e.g. a pulse signal).

The light emitting device illustrated in FIG. 4 achieves the same effect as the light emitting device illustrated in FIG. 3. In addition, the light emitting device illustrated in FIG. 4 can eliminate one external terminal of the lighted element number control IC 2 from the light emitting device illustrated in FIG. 3, because the signal generation circuit 8 generates one abnormality detection signal from the output signal of the AND gate 9 and the output signal of the OR gate 5.

Fifth Structural Example

Figure 11:
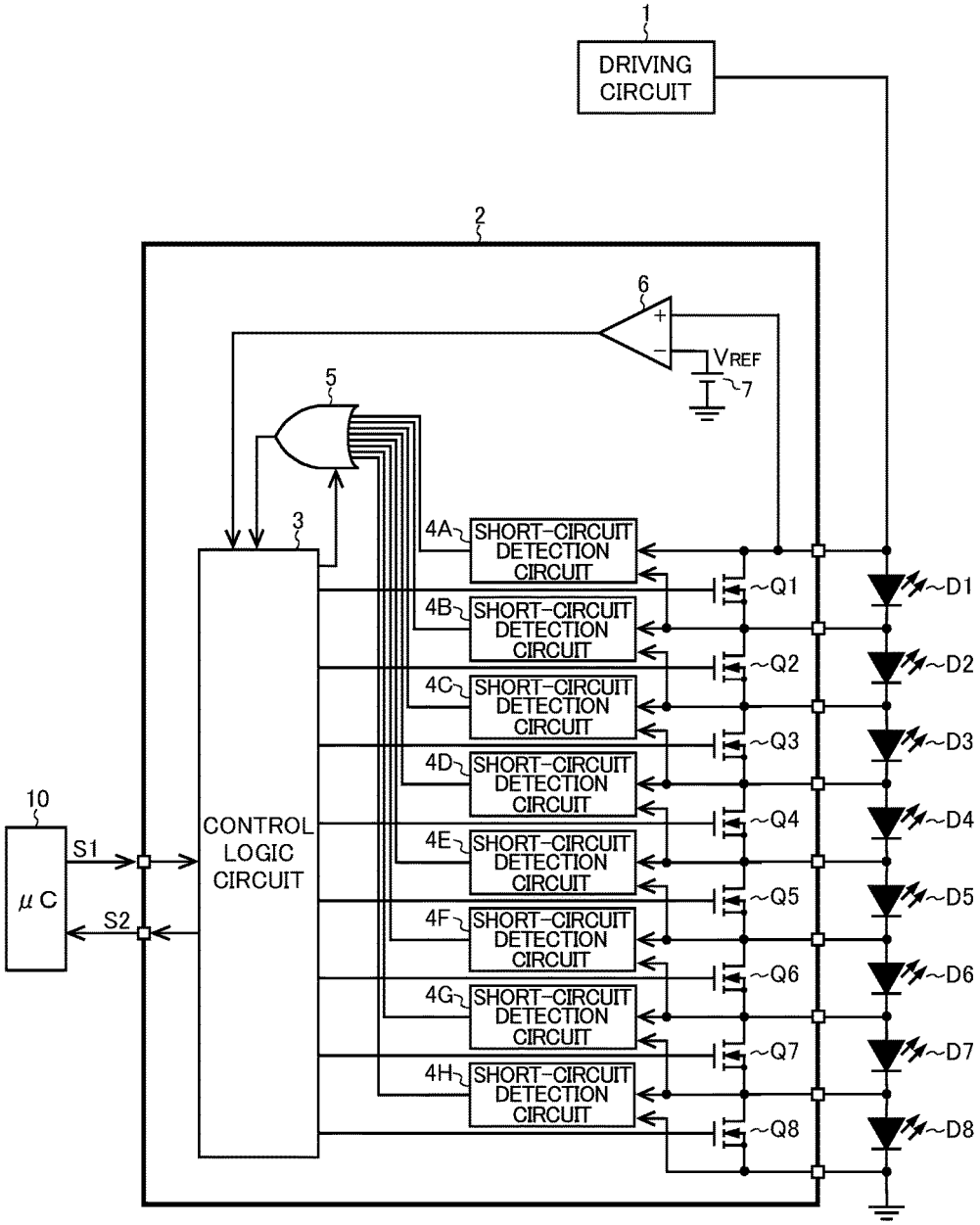
FIG. 11 is a diagram illustrating a fifth structural example of the light emitting device.

FIG. 11 is a diagram illustrating a fifth structural example of the light emitting device. The light emitting device illustrated in FIG. 11 is different from the light emitting device illustrated in FIG. 1 in that the control logic circuit 3 receives the output signal of the OR gate 5 and the output signal of the comparator 6, and has basically the same structure in other points as the light emitting device illustrated in FIG. 1. Further, in the light emitting device illustrated in FIG. 11, the control logic circuit 3 generates an abnormality detection signal S2 based on the output signal of the OR gate 5 and the output signal of the comparator 6, and outputs the abnormality detection signal S2 to an external microcomputer 10. For example, the microcomputer 10 should have the same function as the signal generation circuit 8 in the second structural example described above.

In addition, as illustrated in FIG. 11, it is preferred that the microcomputer 10 be configured to supply the lighted element number indicating signal S1 to the lighted element number control IC 2, but a device other than the microcomputer 10 may supply the lighted element number indicating signal S1 to the lighted element number control IC 2.

Sixth Sructural Example

Figure 12:
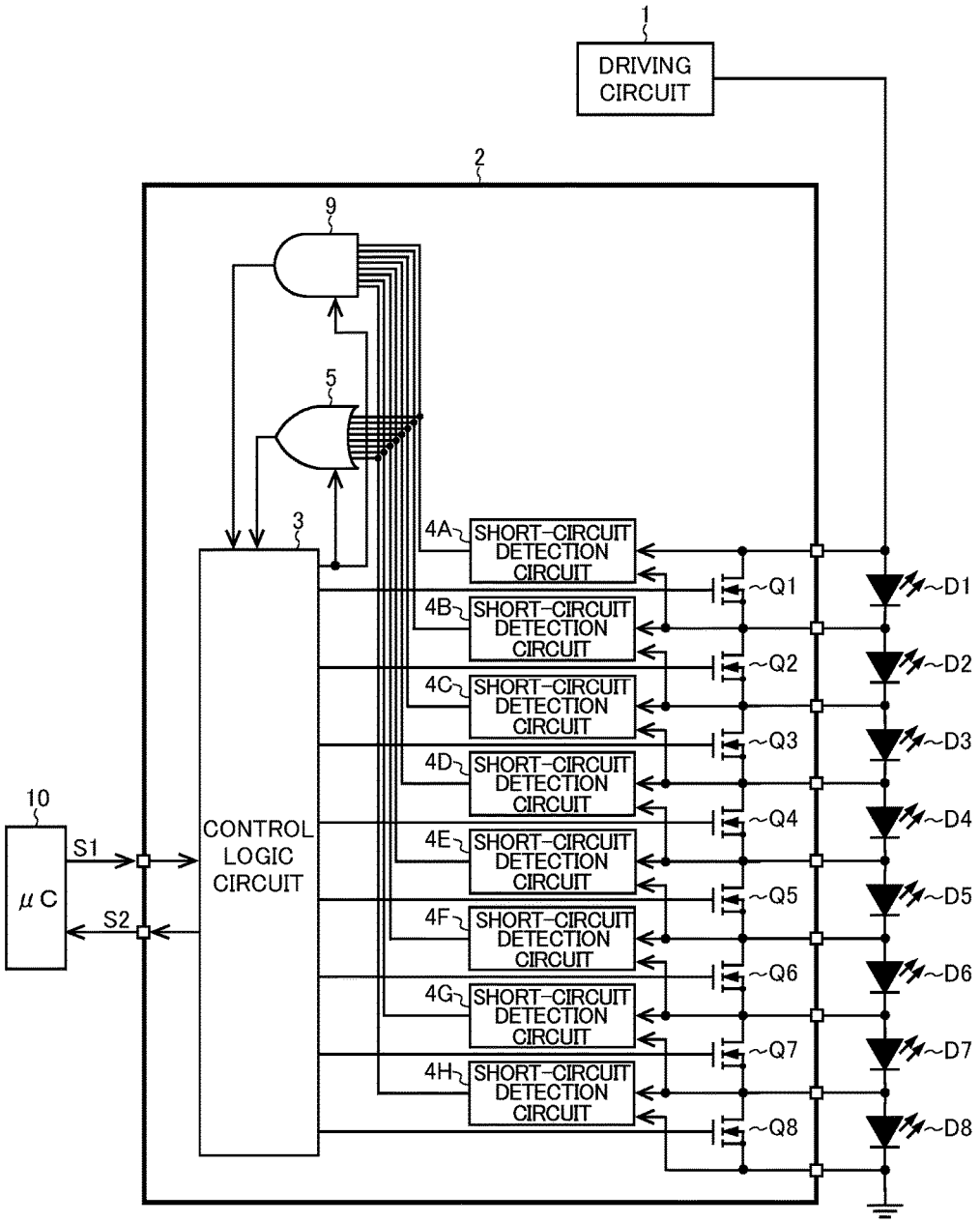
FIG. 12 is a diagram illustrating a sixth structural example of the light emitting device.

FIG. 12 is a diagram illustrating a sixth structural example of the light emitting device. The light emitting device illustrated in FIG. 12 is different from the light emitting device illustrated in FIG. 3 in that the control logic circuit 3 receives the output signal of the OR gate 5 and the output signal of the AND gate 9, and in other points it has basically the same structure as the light emitting device illustrated in FIG. 3. Further, in the light emitting device illustrated in FIG. 12, the control logic circuit 3 generates the abnormality detection signal S2 based on the output signal of the OR gate 5 and the output signal of the AND gate 9, and outputs the abnormality detection signal S2 to the external microcomputer 10. For example, microcomputer 10 should have the same function as the signal generation circuit 8 in the fourth structural example described above.

In addition, as illustrated in FIG. 12, it is preferred that the microcomputer 10 be configured to supply the lighted element number indicating signal S1 to the lighted element number control IC 2, but a device other than the microcomputer 10 may supply the lighted element number indicating signal S1 to the lighted element number control IC 2.

Seventh Structural Example

Figure 13:
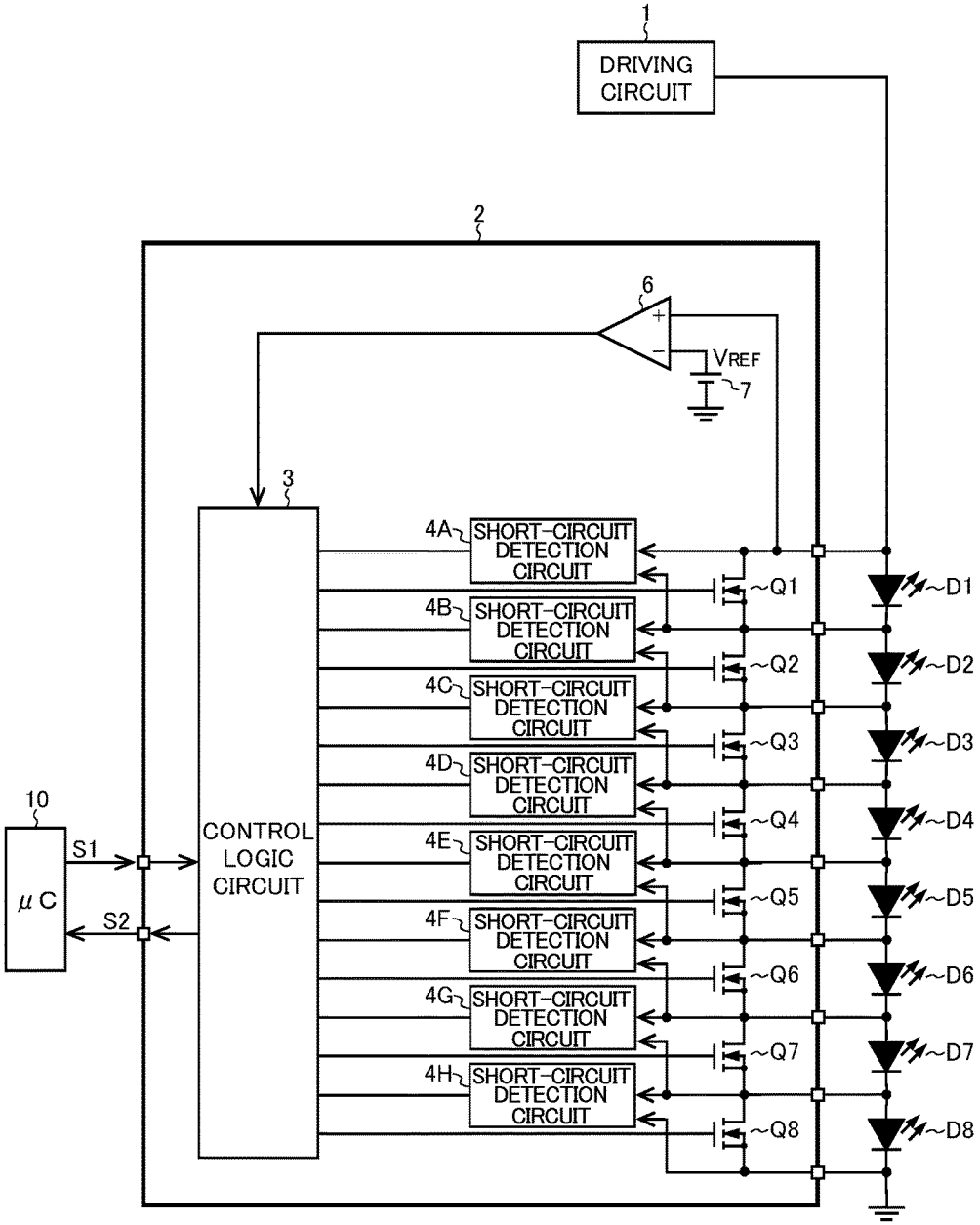
FIG. 13 is a diagram illustrating a seventh structural example of the light emitting device.

FIG. 13 is a diagram illustrating a seventh structural example of the light emitting device. The light emitting device illustrated in FIG. 13 is different from the light emitting device illustrated in FIG. 1 in that the lighted element number control IC 2 does not include the OR gate 5, and that the control logic circuit 3 receives output signals of the short-circuit detection circuits 4A to 4H and the output signal of the comparator 6, and in other point it has basically the same structures as the light emitting device illustrated in FIG. 1. Further, in the light emitting device illustrated in FIG. 13, the control logic circuit 3 generates the abnormality detection signal S2 based on the output signals of the short-circuit detection circuits 4A to 4H and the output signal of the comparator 6, and outputs the abnormality detection signal S2 to the external microcomputer 10. For example, the microcomputer 10 should have the same function as the OR gate 5 and the signal generation circuit 8 in the second structural example described above. In addition, for example, instead that the microcomputer 10 has the same function as the OR gate 5 and the signal generation circuit 8 in the second structural example described above, there may be a determination unit that determines which one of the short-circuit detection circuits 4A to 4H has detected short circuit, and a signal indicating which one of the short-circuit detection circuits 4A to 4H has detected short circuit may be included in the abnormality detection signal S2. Note that as a matter of course, there may be a case where a plurality of short-circuit detection circuits simultaneously detect short circuits, without limiting to a case where a single short-circuit detection circuit detects short circuit.

In addition, as illustrated in FIG. 13, it is preferred that the microcomputer 10 be configured to supply the lighted element number indicating signal S1 to the lighted element number control IC 2, but a device other than the microcomputer 10 may supply the lighted element number indicating signal S1 to the lighted element number control IC 2.

Eighth Structural Example

Figure 14:
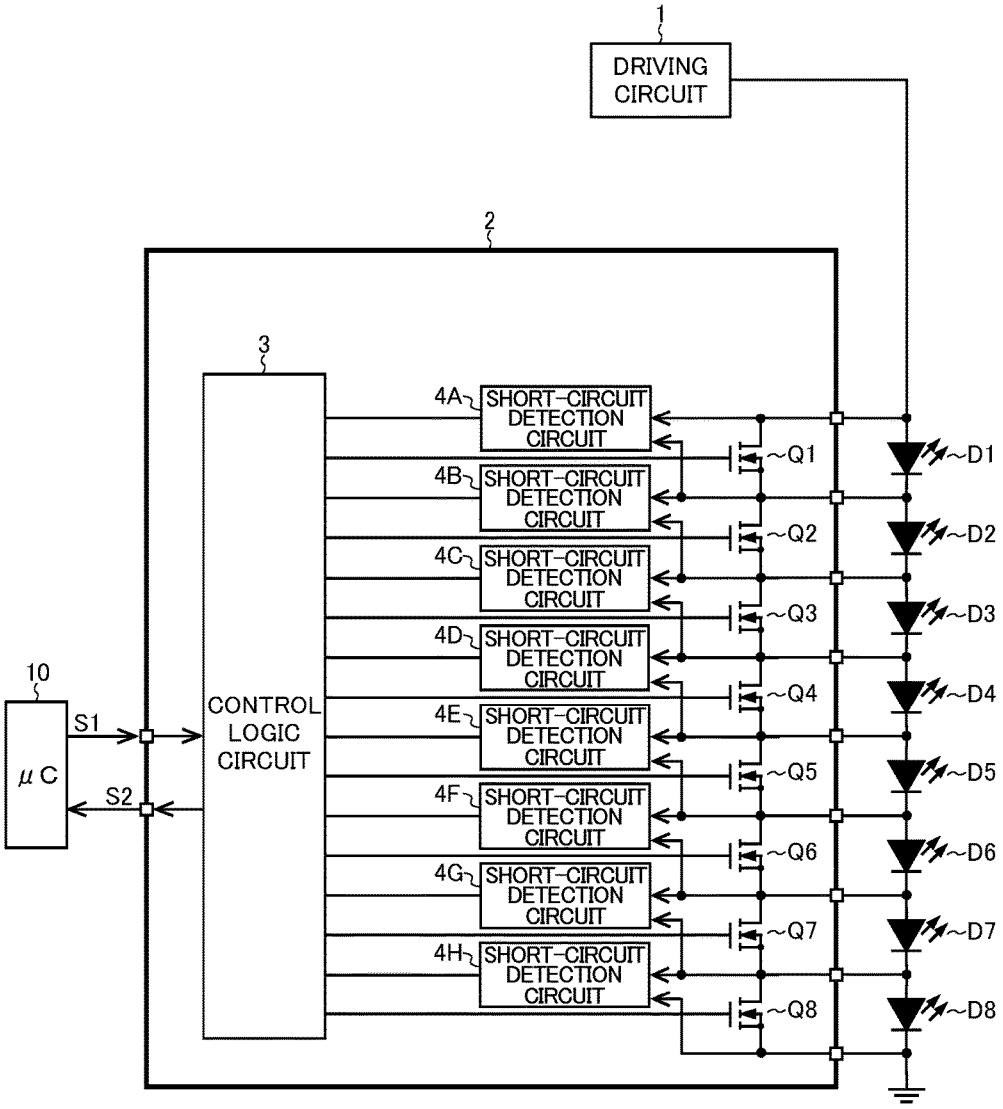
FIG. 14 is a diagram illustrating an eighth structural example of the light emitting device.
Figure 15:
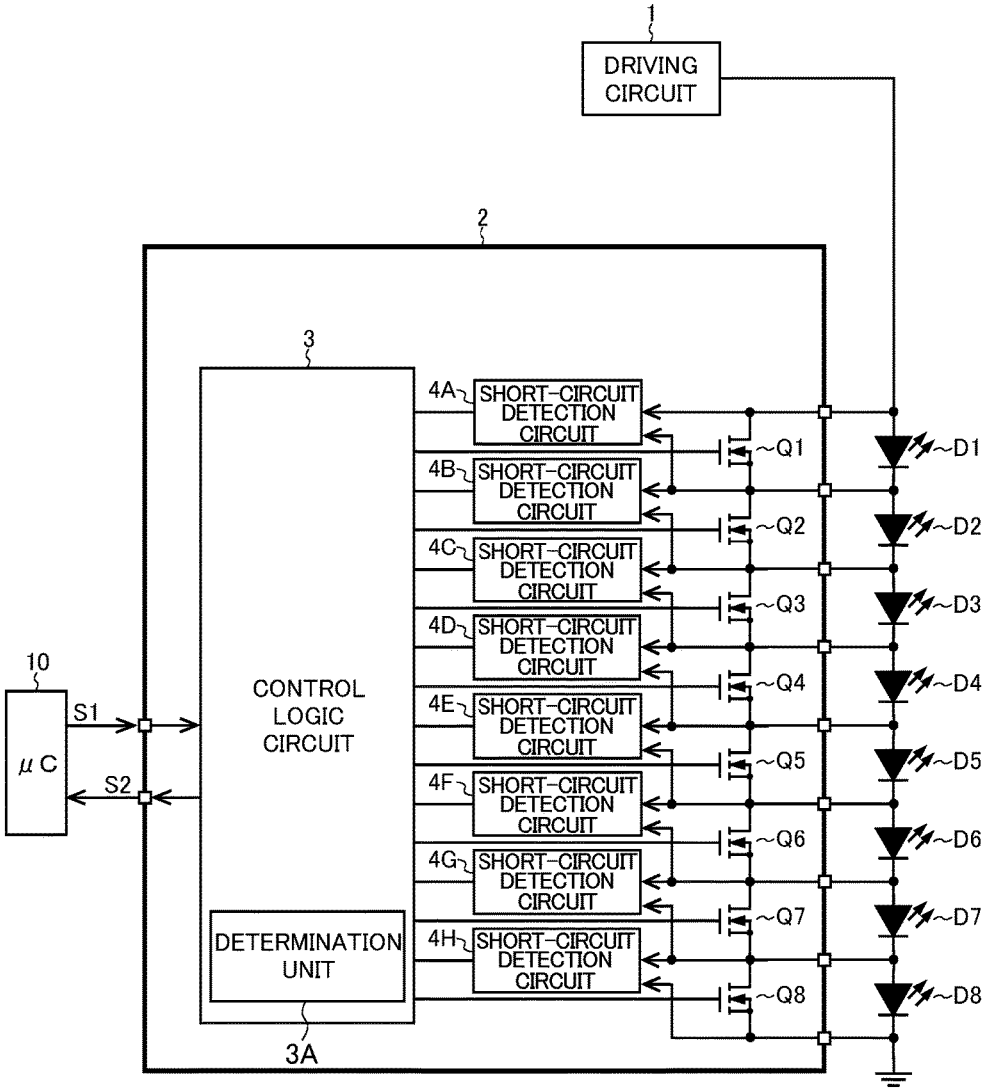
FIG. 15 is a diagram illustrating a specific example of the eighth structural example of the light emitting device.

FIG. 14 is a diagram illustrating an eighth structural example of the light emitting device. The light emitting device illustrated in FIG. 14 is different from the light emitting device illustrated in FIG. 13 in that the lighted element number control IC 2 does not include the comparator 6 and the reference voltage source 7, and in other points it has basically the same structure as the light emitting device illustrated in FIG. 13. Further, in the light emitting device illustrated in FIG. 14, the control logic circuit 3 generates the abnormality detection signal S2 based on the output signals of the short-circuit detection circuits 4A to 4H, and outputs the abnormality detection signal S2 to the external microcomputer 10. For example, the microcomputer 10 should have the same function as the OR gate 5, the AND gate 9, and the signal generation circuit 8 in the fourth structural example described above. In addition, for example, instead that the microcomputer 10 has the same function as the OR gate 5, the AND gate 9, and the signal generation circuit 8 in the fourth structural example described above, there may be a determination unit 3A (see FIG. 15) that determines which one of the short-circuit detection circuits 4A to 4H has detected short circuit is disposed, and a signal indicating which one of the short-circuit detection circuits 4A to 4H has detected short circuit may be included in the abnormality detection signal S2. Note that as a matter of course, there may be a case where a plurality of short-circuit detection circuits simultaneously detect short circuits, without limiting to a case where a single short-circuit detection circuit detects short circuit.

In addition, as illustrated in FIG. 14, it is preferred that the microcomputer 10 be configured to supply the lighted element number indicating signal S1 to the lighted element number control IC 2, but a device other than the microcomputer 10 may supply the lighted element number indicating signal S1 to the lighted element number control IC 2.

Ninth Structural Example

Figure 16:
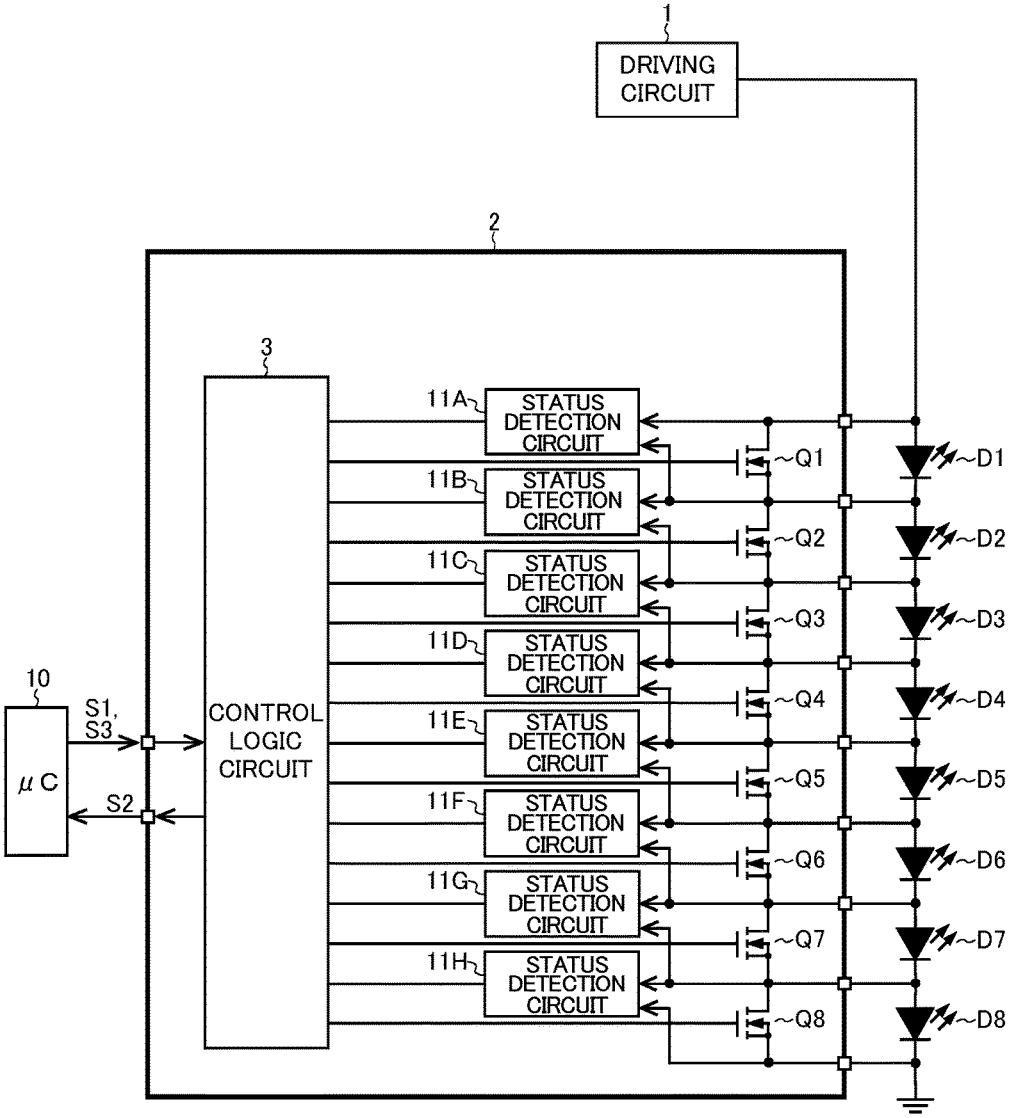
FIG. 16 is a diagram illustrating a ninth structural example of the light emitting device.

FIG. 16 is a diagram illustrating a ninth structural example of the light emitting device. The light emitting device illustrated in FIG. 16 includes the series connection unit constituted of the eight light emitting diodes D1 to D8, the driving circuit 1 that drives the light emitting diodes D1 to D8, and the lighted element number control IC 2 that controls the number of lighted elements in the light emitting diodes D1 to D8. The lighted element number control IC 2 includes the N-channel MOS field-effect transistors Q1 to Q8, the control logic circuit 3 that controls on and off of the transistors Q1 to Q8 according to the lighted element number indicating signal S1 supplied from the external microcomputer 10, and status detection circuits 11A to 11H. Note that the number of the light emitting diodes, the number of the transistors as the short-circuit switches, and the number of the short-circuit detection circuits are eight each in the structural example of FIG. 16, but the numbers of them are not limited to eight and may be other plural number.

The driving circuit 1 is, for example, a series regulator that supplies a constant current to a load connected to the output terminal, a switching regulator that supplies a PWM current having a predetermined on-duty to the load connected to the output terminal, or the like.

The anode of the series connection unit constituted of the light emitting diodes D1 to D8 (anode of the light emitting diode D1) is connected to the output terminal of the driving circuit 1. The cathode of the series connection unit constituted of the light emitting diodes D1 to D8 (cathode of the light emitting diode D8) is connected to the ground.

The both ends of the series connection unit constituted of the light emitting diodes D1 to D8 and each connection node between the light emitting diodes are connected to the lighted element number control IC 2, so that the transistor Qk (k is a natural number equal to or smaller than eight) is connected in parallel to the light emitting diode Dk (k is a natural number equal to or smaller than eight). In this way, the transistor Qk is the short-circuit switch for the light emitting diode Dk.

The control logic circuit 3 controls each gate-source voltage of the transistors Q1 to Q8 so as to control on and off of the transistors Q1 to Q8. Therefore, although not illustrated in FIG. 16, not only the gates of the transistors Q1 to Q8 but also the sources of the transistors Q1 to Q8 are connected to the control logic circuit 3 in reality.

The status detection circuit 11A detects a forward voltage VF of the light emitting diode D1, which is an analog value, when the transistor Q1 is in off state, and sends a detection result to the control logic circuit 3. The control logic circuit 3 processes the detection result from the status detection circuit 11A after A/D conversion, for example. The status detection circuit 11A may operate only when the transistor Q1 is in off state according to an enable signal from the control logic circuit 3, or it may operate also when the transistor Q1 is in on state while the control logic circuit 3 does not use the detection result when the transistor Q1 is in on state. As the status detection circuit 11A, for example, it is possible to use an error amplifier having a noninverting input terminal connected to the drain of the transistor Q1 and an inverting input terminal connected to the source of the transistor Q1. The status detection circuits 11B to 11H also detect anode-cathode voltages of the light emitting diodes D2 to D8 in the same manner.

The control logic circuit 3 sends the information S2 about the anode-cathode voltage of each of the light emitting diodes D1 to D8 to the microcomputer 10. The anode-cathode voltage of the light emitting diode varies depending on deterioration degree of the light emitting diode or ambient condition of the light emitting diode.

For example, the microcomputer 10 detects the anode-cathode voltage based on the information S2 about the anode-cathode voltage of each of the light emitting diodes D1 to D8, and when determining that light emission of the light emitting diode is being weakened because of deterioration of the forward voltage VF, for example, it should perform limp-home control by outputting a limp-home control signal S3 to the control logic circuit 3, so as to secure functional safety.

As an example of the limp-home control, the transistor connected in parallel to the light emitting diode to be turned on is PWM-controlled with a first on-duty in non-limp-home control, and in limp-home control the transistor connected in parallel to the light emitting diode to be turned on is PWM-controlled with a second on-duty larger than the first on-duty. In this way, a decrease in light emission intensity due to a decrease in the forward voltage VF can be compensated, and hence it is possible to secure light emission intensity necessary for securing functional safety. Note that the content of the limp-home control signal S3 may be changed depending on the content of the information S2 about the forward voltage VF of each of the light emitting diodes D1 to D8, and the second on-duty described above may be variable depending on the content of the limp-home control signal S3.

In addition, the microcomputer 10 mainly performs the limp-home control in this example, but the control logic circuit 3 may mainly perform the limp-home control. If the control logic circuit 3 mainly performs the limp-home control, transmission and reception of the information S2 and the signal S3 between the control logic circuit 3 and the microcomputer 10 is not necessary.

Figure 17:
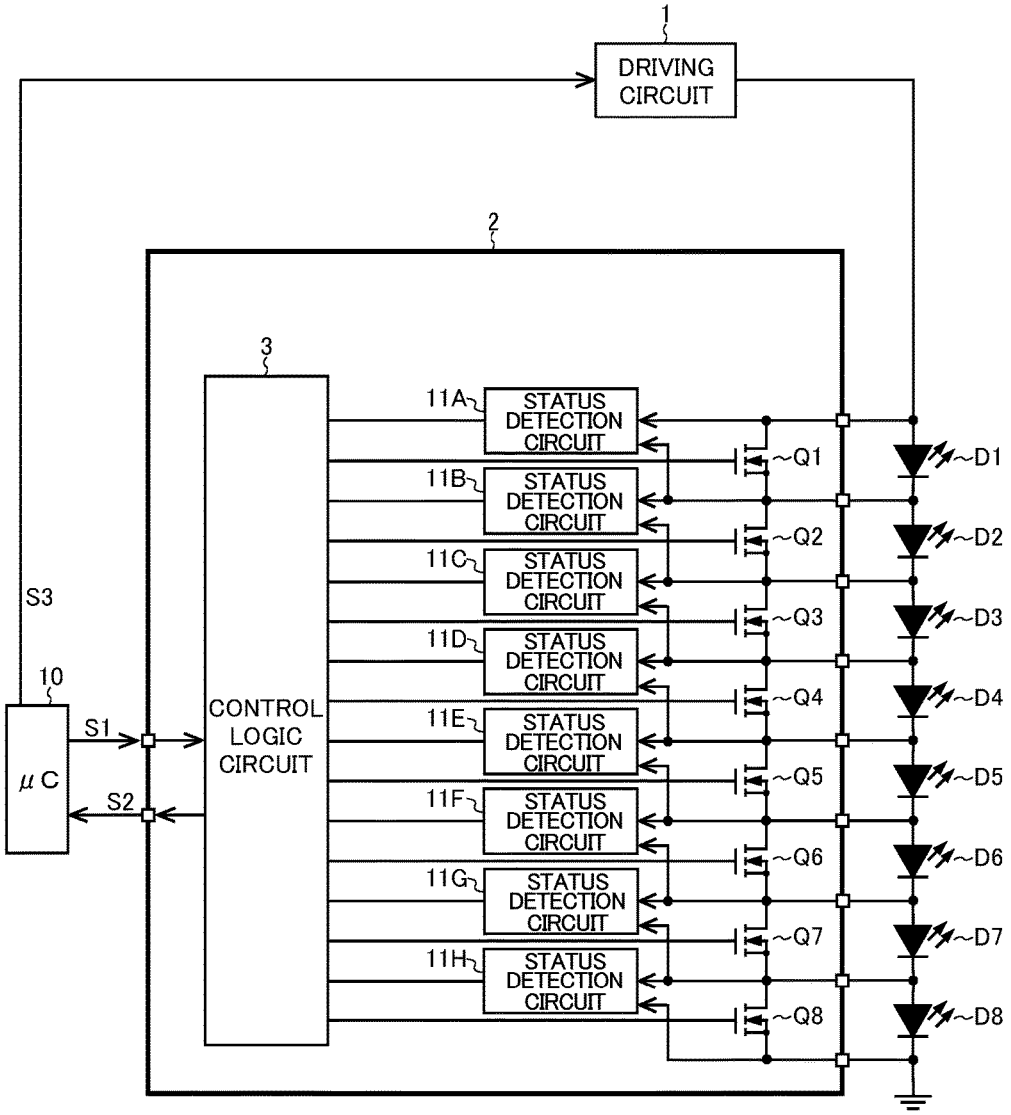
FIG. 17 is a diagram illustrating a variation of the ninth structural example of the light emitting device.

As another example of the limp-home control, as illustrated in FIG. 17, the microcomputer 10 performs the limp-home control by outputting the limp-home control signal S3 not to the control logic circuit 3 but to the driving circuit 1. If the driving circuit 1 is a series regulator that supplies a constant current to a load connected to the output terminal, for example, it sets the constant current to a larger value in the limp-home control than in the non-limp-home control. In addition, if the driving circuit 1 is a switching regulator that supplies a PWM current having a predetermined on-duty to the load connected to the output terminal, for example, it sets the on-duty of the PWM current to a larger value in the limp-home control than in the non-limp-home control.

In addition, the microcomputer 10 mainly performs the limp-home control in the example illustrated in FIG. 17, but the control logic circuit 3 may mainly perform the limp-home control. When the control logic circuit 3 mainly performs the limp-home control, the control logic circuit 3 should be configured to output the limp-home control signal to the driving circuit 1.

In each example described above, the microcomputer 10 performs the limp-home control when determining that there is a light emitting diode having the forward voltage VF lower than a permissible value based on the information S2 about the forward voltage VF of each of the light emitting diodes D1 to D8. However, instead of the limp-home control, it is possible to perform full turn-off control in which all the light emitting diodes D1 to D8 are turned off. When performing the full turn-off control, current output from the driving circuit 1 is stopped.

In addition, it is possible to configure so that the limp-home control or the full turn-off control can be selected and performed. For example, when the light emitting device is mounted in a vehicle, information about whether the vehicle is running or is stopped is received by the light emitting device, and the limp-home control is selected when the vehicle is running, while the full turn-off control is selected when the vehicle is stopped.

Tenth Structural Example

Figure 18:
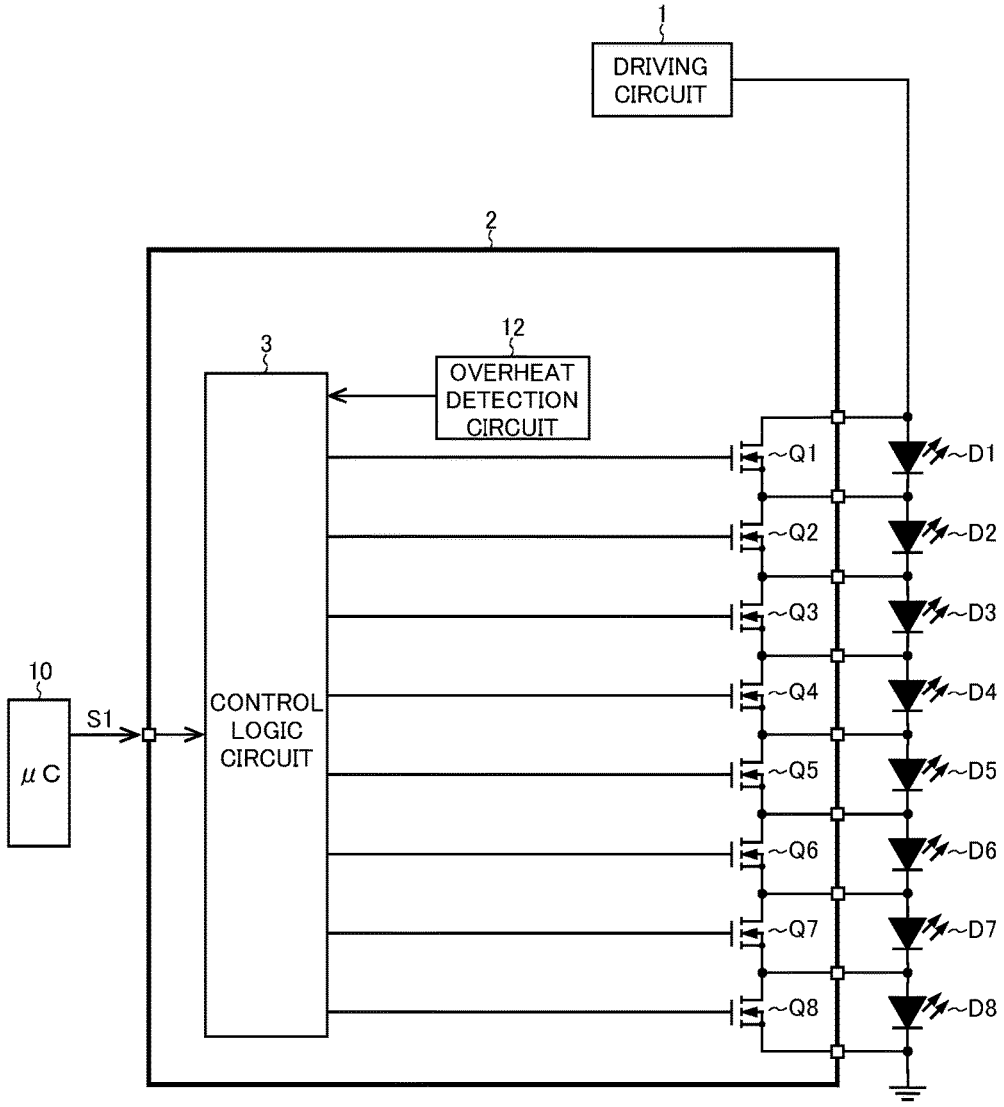
FIG. 18 is a diagram illustrating a tenth structural example of the light emitting device.

FIG. 18 is a diagram illustrating a tenth structural example of the light emitting device. The light emitting device illustrated in FIG. 18 includes the series connection unit constituted of the eight light emitting diodes D1 to D8, the driving circuit 1 that drives the light emitting diodes D1 to D8, and the lighted element number control IC 2 that controls the number of lighted elements in the light emitting diodes D1 to D8. The lighted element number control IC 2 includes the N-channel MOS field-effect transistors Q1 to Q8, the control logic circuit 3 that controls on and off of the transistors Q1 to Q8 according to the lighted element number indicating signal S1 supplied from the external microcomputer 10, and an overheat detection circuit 12. Note that the number of the light emitting diodes, the number of the transistors as the short-circuit switches, and the number of the short-circuit detection circuits are eight each in the structural example of FIG. 18, but the numbers of them are not limited to eight and may be other plural number.

The driving circuit 1 is, for example, a series regulator that supplies a constant current to a load connected to the output terminal, a switching regulator that supplies a PWM current having a predetermined on-duty to the load connected to the output terminal, or the like.

The anode of the series connection unit constituted of the light emitting diodes D1 to D8 (anode of the light emitting diode D1) is connected to the output terminal of the driving circuit 1. The cathode of the series connection unit constituted of the light emitting diodes D1 to D8 (cathode of the light emitting diode D8) is connected to the ground.

The both terminals of the series connection unit constituted of the light emitting diodes D1 to D8 and each connection node between the light emitting diodes are connected to the lighted element number control IC 2 so that the transistor Qk (k is a natural number equal to or smaller than eight) is connected in parallel to the light emitting diode Dk (k is a natural number equal to or smaller than eight). In this way, the transistor Qk is the short-circuit switch for the light emitting diode Dk.

The control logic circuit 3 controls each gate-source voltage of the transistors Q1 to Q8 so as to control on/off of the transistors Q1 to Q8. Therefore, although not illustrated in FIG. 18, not only the gates of the transistors Q1 to Q8 but also the sources of the transistors Q1 to Q8 are connected to the control logic circuit 3 in reality.

The overheat detection circuit 12 detects internal temperature of the lighted element number control IC 2, and it detects overheat when the detected temperature becomes higher than a threshold value.

When the overheat detection circuit 12 detects overheat, the control logic circuit 3 performs overheat protection control in which all the transistors Q1 to Q8 are turned off regardless of the content of the lighted element number indicating signal S1 supplied from the external microcomputer 10. By turning off all the transistors Q1 to Q8, heating in the transistors Q1 to Q8 can be prevented, and hence an increase of temperature in the lighted element number control IC 2 can be suppressed.

Note that when the overheat detection circuit 12 detects overheat, instead of performing the overheat protection control in which all the transistors Q1 to Q8 are turned off, the control logic circuit 3 may maintain a part of the transistors Q1 to Q8 in on state while increasing the number of transistors to be turned off compared with just before the overheat detection circuit 12 detects overheat.

Figure 19:
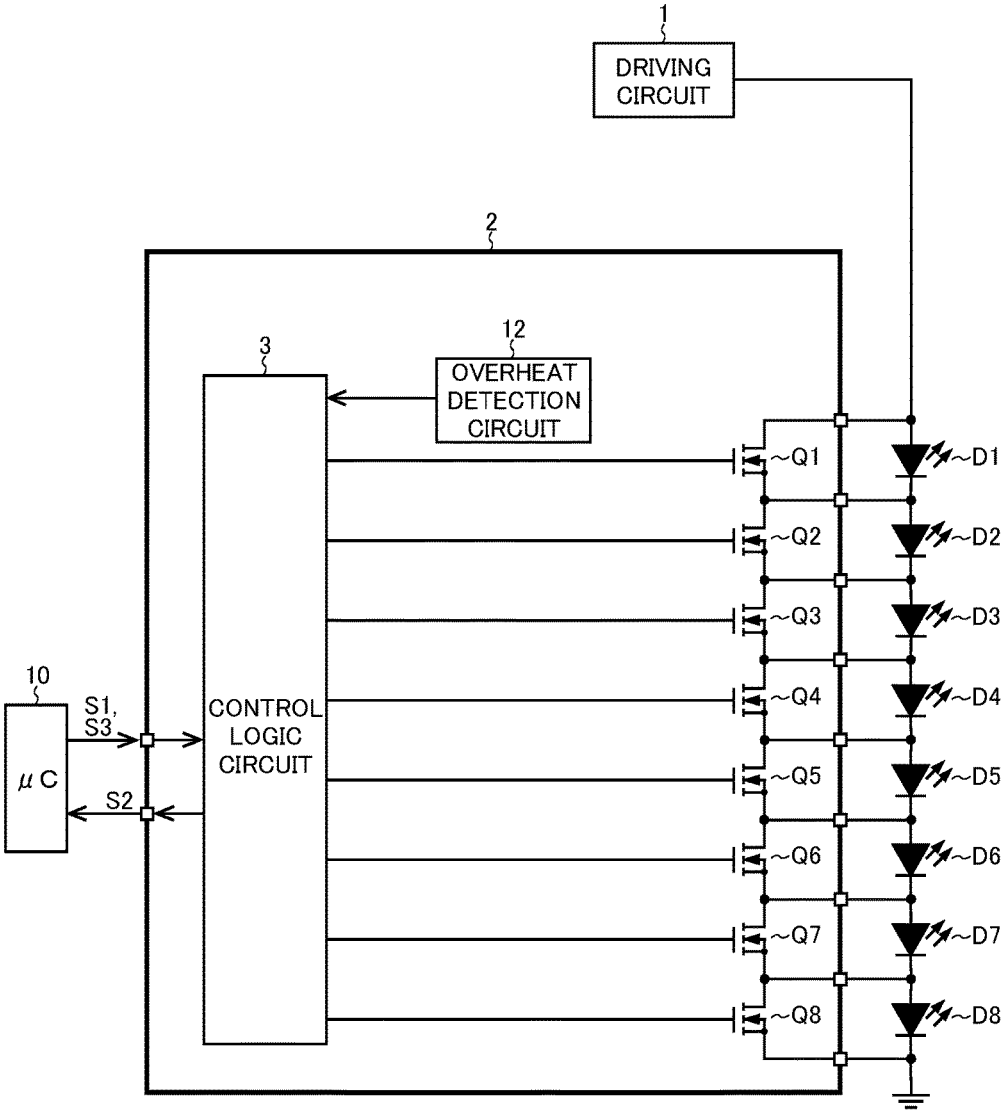
FIG. 19 is a diagram illustrating a variation of the tenth structural example of the light emitting device.

In addition, the control logic circuit 3 mainly performs the overheat protection control in this example, but the microcomputer 10 may mainly perform the overheat protection control. When the microcomputer 10 mainly performs the overheat protection control, as illustrated in FIG. 19 for example, the signal S2 indicating that the overheat is detected and the signal S3 for increasing the number of transistors to be turned off are transmitted and received between the control logic circuit 3 and the microcomputer 10.

Figure 20:
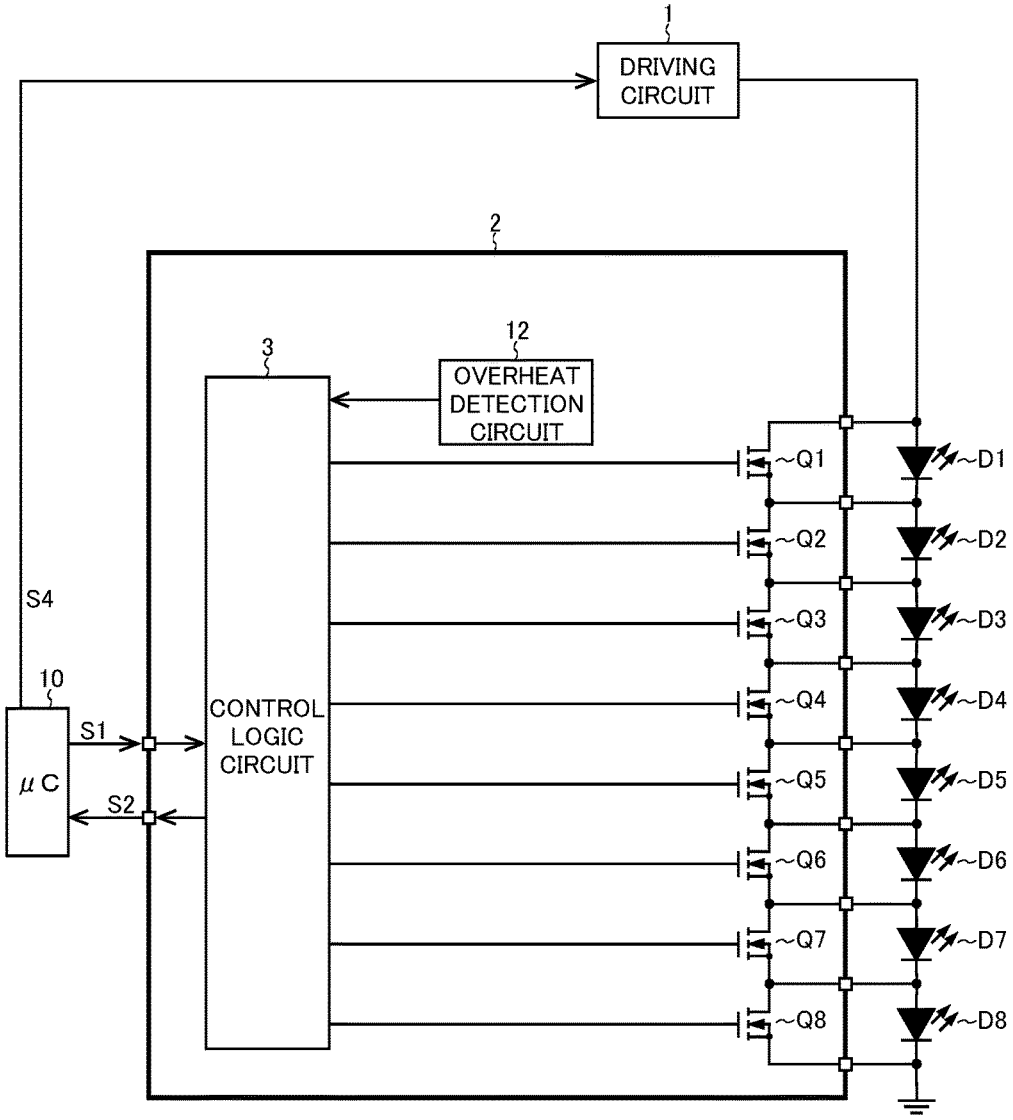
FIG. 20 is a diagram illustrating another variation of the tenth structural example of the light emitting device.

Note that when the number of transistors to be turned off is increased, light emission intensity is increased unless the output current of the driving circuit 1 is changed. Therefore, as illustrated in FIG. 20 for example, a signal S4 for instructing output suppression is sent from the microcomputer 10 to the driving circuit 1 so that the driving circuit 1 performs the output suppression. Note that performing the output suppression by maximum level means stopping the output. In other words, stopping the output is one form of the output suppression.

If the driving circuit 1 is a series regulator that supplies a constant current to a load connected to the output terminal, for example, it performs the output suppression by decreasing the value of the constant current. In addition, if the driving circuit 1 is a switching regulator that supplies a PWM current having a predetermined on-duty to the load connected to the output terminal, for example, it performs the output suppression by decreasing the on-duty of the PWM current.

In addition, the microcomputer 10 instructs the output suppression to the driving circuit 1 in the example illustrated in FIG. 20, but the control logic circuit 3 may instruct the output suppression to the driving circuit 1. When the control logic circuit 3 instructs the output suppression to the driving circuit 1, the control logic circuit 3 should output the signal for instructing the output suppression to the driving circuit 1.

Eleventh Structural Example

Figure 21:
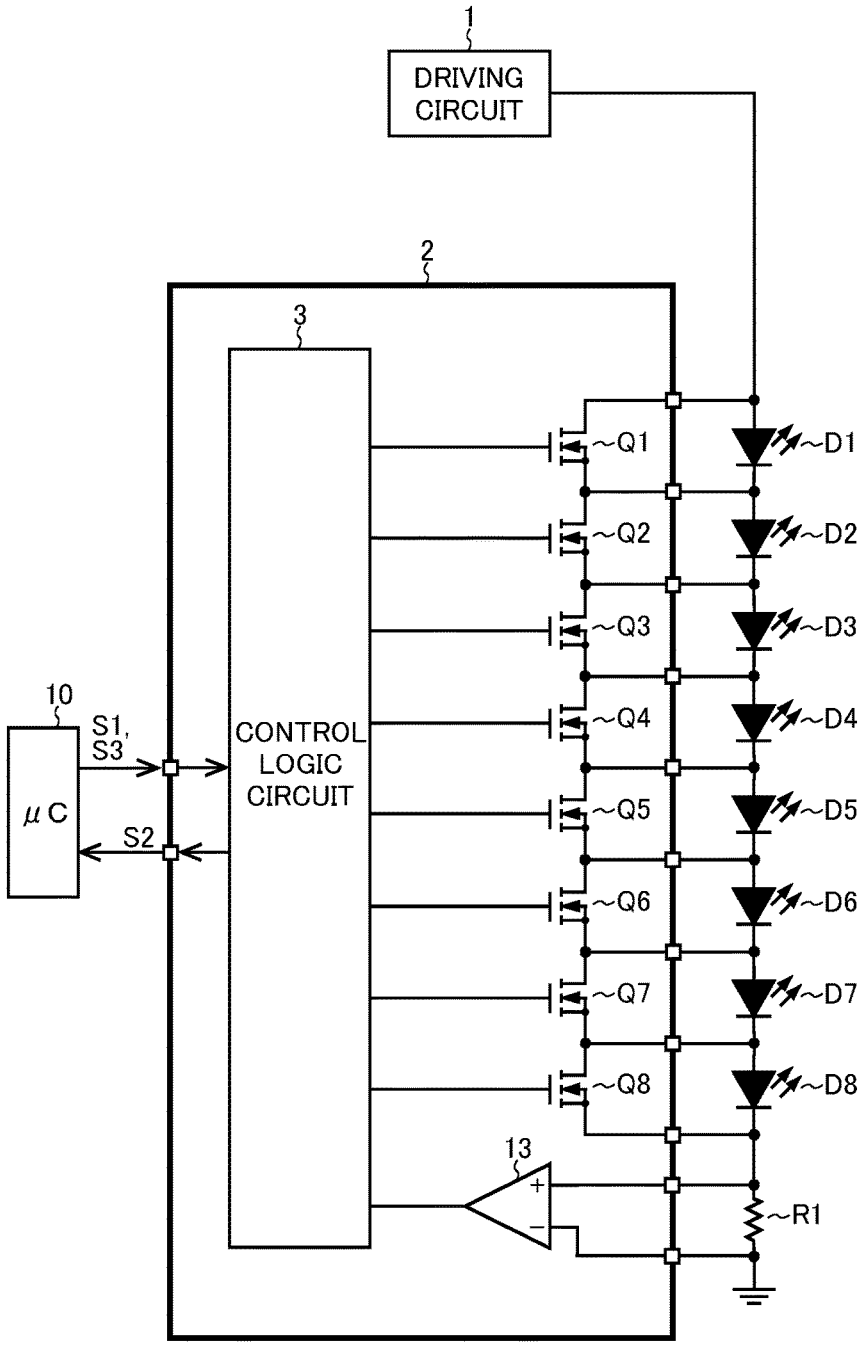
FIG. 21 is a diagram illustrating an eleventh structural example of the light emitting device.

FIG. 21 is a diagram illustrating an eleventh structural example of the light emitting device. The light emitting device illustrated in FIG. 21 includes the series connection unit constituted of the eight light emitting diodes D1 to D8, the driving circuit 1 that drives the light emitting diodes D1 to D8, and the lighted element number control IC 2 that controls the number of lighted elements in the light emitting diodes D1 to D8. The lighted element number control IC 2 includes the N-channel MOS field-effect transistors Q1 to Q8, the control logic circuit 3 that controls on and off of the transistors Q1 to Q8 according to the lighted element number indicating signal S1 supplied from the external microcomputer 10, and an error amplifier 13. Note that the number of the light emitting diodes, the number of the transistors as the short-circuit switches, and the number of the short-circuit detection circuits are eight each in the structural example of FIG. 21, but the numbers of them are not limited to eight and may be other plural number.

The driving circuit 1 is, for example, a series regulator that supplies a constant current to a load connected to the output terminal, a switching regulator that supplies a PWM current having a predetermined on-duty to the load connected to the output terminal, or the like.

The anode of the series connection unit constituted of the light emitting diodes D1 to D8 (anode of the light emitting diode D1) is connected to the output terminal of the driving circuit 1. The cathode of the series connection unit constituted of the light emitting diodes D1 to D8 (cathode of the light emitting diode D8) is connected to the ground via a rank resistor R1. The light emission element such as a light emitting diode or an organic EL is ranked according to its luminance characteristic (i.e. a luminance level obtained when a predetermined drive current is supplied). The light emitting diodes of the same rank are used as the light emitting diodes D1 to D8, and the rank resistor R1 has a resistance value corresponding to the rank of the light emitting diodes D1 to D8. If they have different ranks, the resistance value of the rank resistor R1 is set so that the multiplication value of the resistance value of the rank resistor R1 and the output current of the driving circuit 1 (current that varies within a predetermined range by adjustment) definitely becomes different values.

The both terminals of the series connection unit constituted of the light emitting diodes D1 to D8 and each connection node between the light emitting diodes are connected to the lighted element number control IC 2 so that the transistor Qk (k is a natural number equal to or smaller than eight) is connected in parallel to the light emitting diode Dk (k is a natural number equal to or smaller than eight). In this way, the transistor Qk is the short-circuit switch for the light emitting diode Dk.

The control logic circuit 3 controls each gate-source voltage of the transistors Q1 to Q8 so as to control on/off of the transistors Q1 to Q8. Therefore, although not illustrated in FIG. 18, not only the gates of the transistors Q1 to Q8 but also the sources of the transistors Q1 to Q8 are connected to the control logic circuit 3 in reality.

The error amplifier 13 outputs to the control logic circuit 3 an output signal corresponding to a voltage drop of the rank resistor. In other words, the error amplifier 13 detects the rank of the light emitting diodes D1 to D8 and outputs a detection result to the control logic circuit 3.

The control logic circuit 3 sends the information S2 about the rank of the light emitting diodes D1 to D8 to the microcomputer 10.

For example, on the basis of the information S2 about the rank of the light emitting diodes D1 to D8, the microcomputer 10 should output the luminance adjustment signal S3 to the control logic circuit 3 so as to perform luminance adjustment.

As an example of the luminance adjustment, the transistor connected in parallel to the light emitting diode to be turned on should be PWM-controlled with the on-duty corresponding to the rank of the light emitting diodes D1 to D8. In this way, luminance of the light emitting diodes D1 to D8 is automatically adjusted according to the rank of the light emitting diodes D1 to D8.

In addition, the microcomputer 10 mainly performs the luminance adjustment in this example, but the control logic circuit 3 may mainly perform the luminance adjustment. When the control logic circuit 3 mainly performs the luminance adjustment, transmission and reception of the information S2 and the signal S3 between the control logic circuit 3 and the microcomputer 10 is not necessary.

Figure 22:
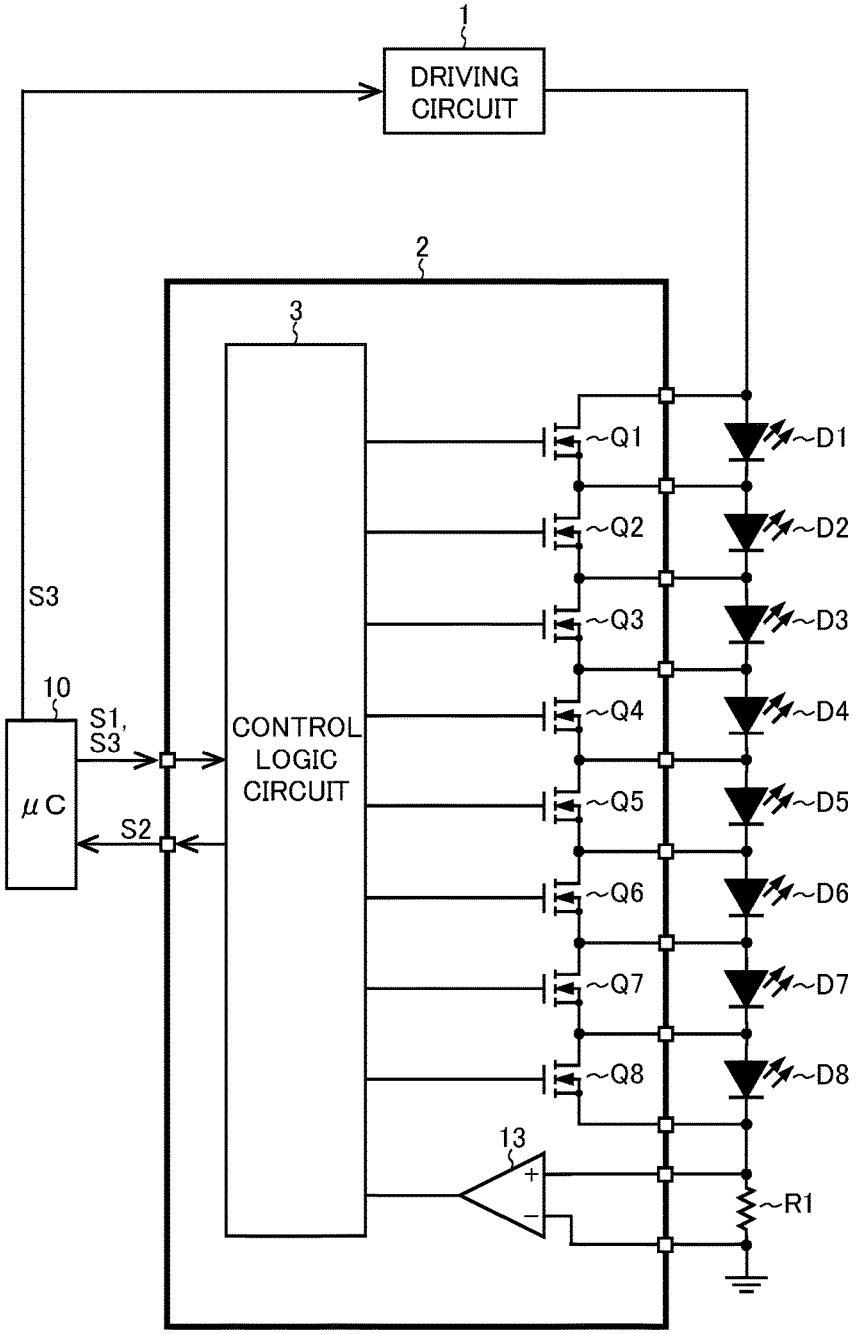
FIG. 22 is a diagram illustrating a variation of the eleventh structural example of the light emitting device.

As another example of the luminance adjustment, as illustrated in FIG. 22, the microcomputer 10 outputs the luminance adjustment signal S3 not to the control logic circuit 3 but to the driving circuit 1 so as to perform the luminance adjustment. If the driving circuit 1 is a series regulator that supplies a constant current to a load connected to the output terminal, for example, the value of the constant current is changed according to the rank of the light emitting diodes D1 to D8. In addition, if the driving circuit 1 is a switching regulator that supplies a PWM current having a predetermined on-duty to the load connected to the output terminal, for example, the on-duty of the PWM current is changed according to the rank of the light emitting diodes D1 to D8.

In addition, the microcomputer 10 mainly performs the luminance adjustment in the example illustrated in FIG. 22, but the control logic circuit 3 may mainly perform the luminance adjustment. If the control logic circuit 3 mainly performs the luminance adjustment, the control logic circuit 3 should be configured to output the luminance adjustment signal to the driving circuit 1.

Figure 23:
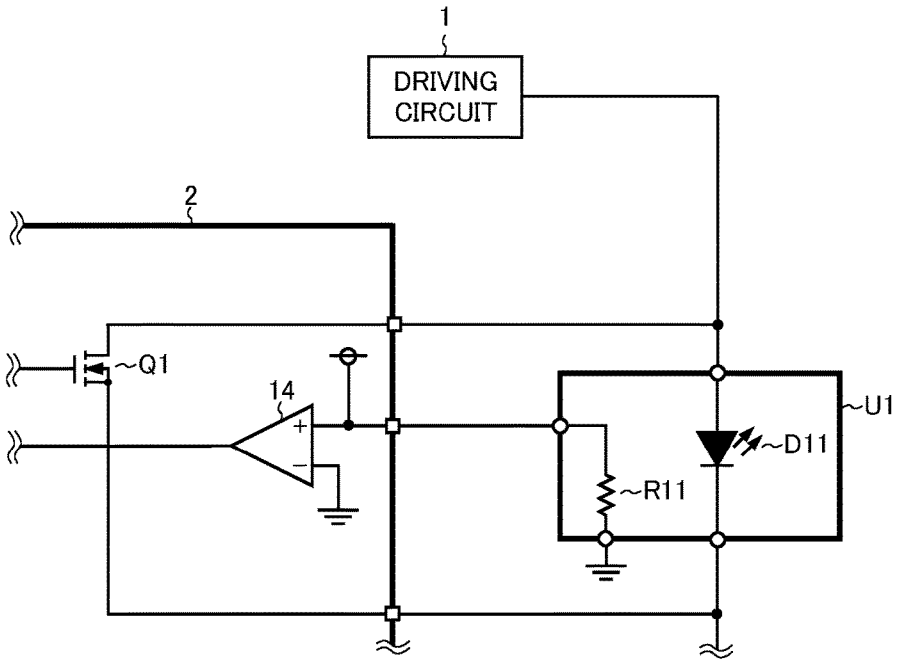
FIG. 23 is a diagram illustrating a main part of another variation of the eleventh structural example of the light emitting device.

In addition, in the structure illustrated in FIG. 21, the light emitting diode D1 may be replaced with a light emitting diode unit U1 as illustrated in FIG. 23. The light emitting diode unit U1 includes a light emitting diode D11 and a rank resistor R11 having a resistance value corresponding to a rank of the light emitting diode D11. The light emitting diodes D2 to D8 should be replaced in the same manner. Further, the lighted element number control IC 2 should include eight error amplifiers corresponding to the individual light emitting diode units (only an error amplifier 14 corresponding to the light emitting diode unit U1 is illustrated in FIG. 23) instead of the error amplifier 13. In the light emitting device illustrated in FIG. 23, the luminance adjustment responding to output signals of the eight error amplifiers corresponding to the individual light emitting diode units is performed. Specifically, when turning on the light emitting diode unit U1, the transistor Q1 connected in parallel to the light emitting diode D11 should be PWM-controlled with an on-duty corresponding to the rank of the light emitting diode D11. Other transistors Q2 to Q8 should be PWM-controlled in the same manner. Either the microcomputer 10 or the control logic circuit 3 may mainly perform the luminance adjustment. According to the light emitting device illustrated in FIG. 23, it is not necessary to uniform ranks of the light emitting diodes, and hence work efficiency of producing the light emitting device is improved.

Twelfth Structural Example

Figure 24:
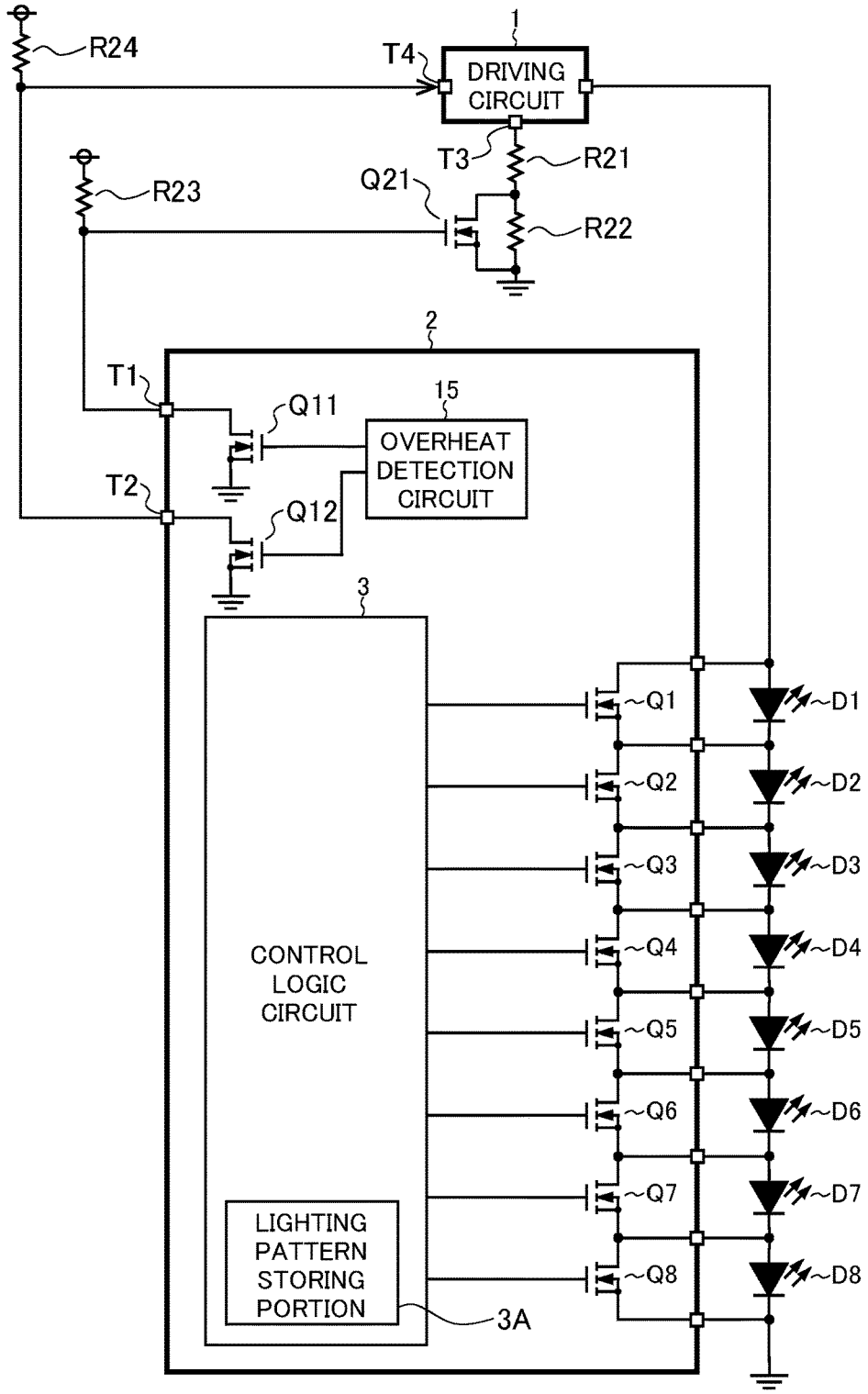
FIG. 24 is a diagram illustrating a twelfth structural example of the light emitting device.

FIG. 24 is a diagram illustrating a twelfth structural example of the light emitting device. The light emitting device illustrated in FIG. 24 includes the series connection unit constituted of the eight light emitting diodes D1 to D8, the driving circuit 1 that drives the light emitting diodes D1 to D8, the lighted element number control IC 2 that controls the number of lighted elements in the light emitting diodes D1 to D8, current value setting resistors R21 and R22, pull-up resistors R23 and R24, and a current value setting transistor Q21. The lighted element number control IC 2 includes the N-channel MOS field-effect transistors Q1 to Q8, the control logic circuit 3 that controls on and off of the transistors Q1 to Q8, an overheat detection circuit 15, and N-channel MOS field-effect transistors Q11 and Q12. The control logic circuit 3 includes a lighting pattern storing portion 3A that stores in a nonvolatile manner a lighting pattern of the light emitting diodes D1 to D8. The control logic circuit 3 controls on/off of the transistors Q1 to Q8 according to the lighting pattern stored in the lighting pattern storing portion 3A. Therefore, a microcomputer is not necessary in this example. Note that the number of the light emitting diodes, the number of the transistors as the short-circuit switches, and the number of the short-circuit detection circuits are eight each in the structural example of FIG. 18, but the numbers of them are not limited to eight and may be other plural number.

The driving circuit 1 is, for example, a series regulator that supplies a constant current to a load connected to the output terminal, a switching regulator that supplies a PWM current having a predetermined on-duty to the load connected to the output terminal, or the like.

The anode of the series connection unit constituted of the light emitting diodes D1 to D8 (anode of the light emitting diode D1) is connected to the output terminal of the driving circuit 1. The cathode of the series connection unit constituted of the light emitting diodes D1 to D8 (the cathode of the light emitting diode D8) is connected to the ground.

The both terminals of the series connection unit constituted of the light emitting diodes D1 to D8 and each connection node between the light emitting diodes are connected to the lighted element number control IC 2 so that the transistor Qk (k is a natural number equal to or smaller than eight) is connected in parallel to the light emitting diode Dk (k is a natural number equal to or smaller than eight). In this way, the transistor Qk is the short-circuit switch for the light emitting diode Dk.

The control logic circuit 3 controls each gate-source voltage of the transistors Q1 to Q8 so as to control on/off of the transistors Q1 to Q8. Therefore, although not illustrated in FIG. 24, not only the gates of the transistors Q1 to Q8 but also the sources of the transistors Q1 to Q8 are connected to the control logic circuit 3 in reality.

The overheat detection circuit 12 detects internal temperature of the lighted element number control IC 2. When the detected temperature exceeds a first threshold value, a first stage overheat is detected. When the detected temperature exceeds a second threshold value more than the first threshold value, a second stage overheat is detected.

When the overheat detection circuit 12 does not detect overheat, both the transistors Q11 and Q12 are turned off, and voltages of terminals T1 and T2 of the lighted element number control IC 2 become high level. Because the voltage at the terminal T1 is high level, the transistor Q21 is turned on so as to cause an equivalent state in which only the resistor R21 is connected to a terminal T3 of the driving circuit 1. In addition, because the voltage at the terminal T2 is high level, voltage of a terminal T4 of the driving circuit 1 also become high level.

When the overheat detection circuit 12 detects the first stage overheat, the transistor Q11 is turned on while the transistor Q12 is turned off, and the voltage at the terminal T1 of the lighted element number control IC 2 becomes low level while the voltage at the terminal T2 of the lighted element number control IC 2 becomes high level. Because the terminal T1 is at low level, the transistor Q21 is turned off so as to cause an equivalent state in which the combined resistance of the resistors R21 and R22 is connected to the terminal T3 of the driving circuit 1. In addition, because the voltage at the terminal T2 is high level, the voltage at the terminal T4 of the driving circuit 1 also becomes high level.

When the overheat detection circuit 12 detects the second stage overheat, both the transistors Q11 and Q12 are turned on, and the voltages at the terminals T1 and T2 of the lighted element number control IC 2 become low level. Because the voltage at the terminal T1 is low level, the transistor Q21 is turned off so as to cause the equivalent state in which the combined resistance of the resistors R21 and R22 is connected to the terminal T3 of the driving circuit 1. In addition, because the voltage at the terminal T2 is low level, the voltage at the terminal T4 of the driving circuit 1 also becomes low level.

The driving circuit 1 outputs current having a current value (or on-duty in the case of the PWM current) corresponding to a resistance value of the resistor connected to the terminal T3. The resistance values of the resistors R21 and R22 are set so that the output current of the driving circuit 1 becomes smaller when the combined resistance of the resistors R21 and R22 is connected to the terminal T3 than when the resistor R21 is connected to the terminal T3. In addition, the driving circuit 1 is enabled when the voltage at the terminal T4 is high level, while it is disabled when the voltage at the terminal T4 is low level. Therefore, when the first stage overheat is detected, the output current of the driving circuit 1 is decreased. Despite the decrease of the output current of the driving circuit 1, if the overheated state continues so that the second stage overheat is reached, and when the second stage overheat is detected, the output of the driving circuit 1 is stopped. By this overheat protection, even if a microcomputer is not provided, the lighted element number control IC 2 can be appropriately protected.

Thirteenth Structural Example

Figure 25:
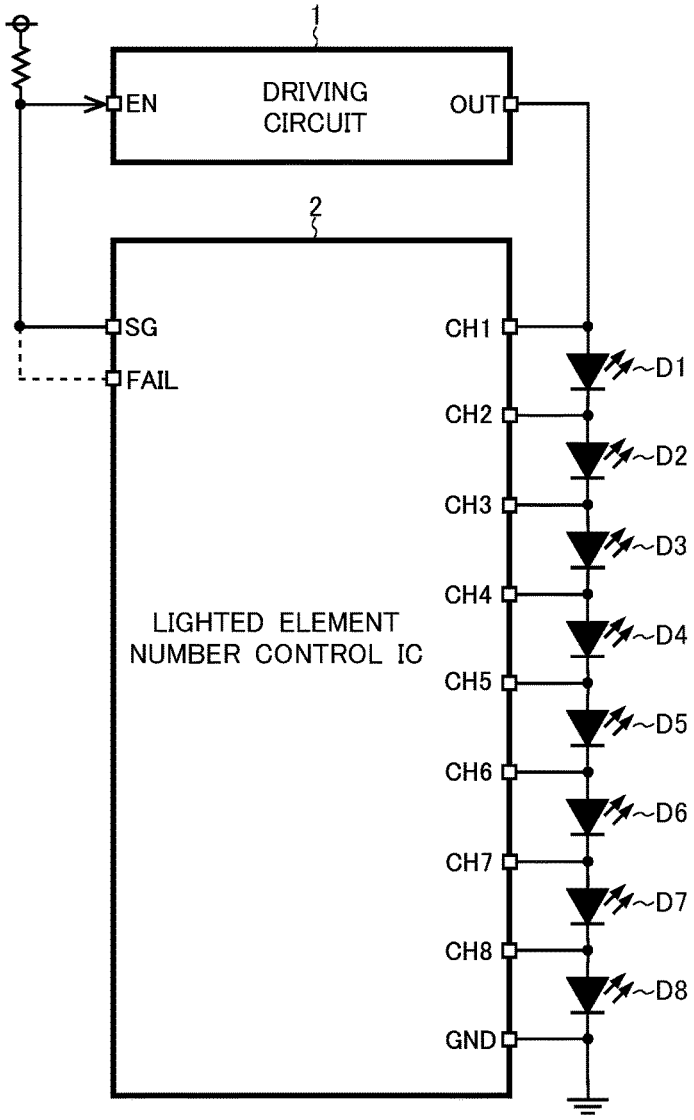
FIG. 25 is a diagram illustrating a thirteenth structural example of the light emitting device.

FIG. 25 is a diagram illustrating a thirteenth structural example of the light emitting device. The light emitting device illustrated in FIG. 25 includes the series connection unit constituted of the eight light emitting diodes D1 to D8, the driving circuit 1 that drives the light emitting diodes D1 to D8, the lighted element number control IC 2 that controls the number of lighted elements in the light emitting diodes D1 to D8, and a pull-up resistor. In the same manner as the other structural examples, the lighted element number control IC 2 of this example also includes the control logic circuit 3 (not shown in FIG. 25) and the transistors Q1 to Q8 (not shown in FIG. 25) as the short-circuit switches.

The driving circuit 1 has a function of monitoring an SG terminal voltage (corresponding to a current supply start trigger) of the lighted element number control IC 2, and waiting for starting supply of drive current until an operation unstable period of the lighted element number control IC 2 elapses.

After turning on power to the lighted element number control IC 2, the operation unstable period of the transistors Q1 to Q8 is generated. Therefore, if the drive current is output from the driving circuit 1 before the operation unstable period elapses, the light emitting diodes D1 to D8 may unintentionally cause instantaneous lighting.

Therefore, after the operation unstable period of the transistors Q1 to Q8 elapses, the control logic circuit 3 outputs to the driving circuit 1 the current supply start trigger for the light emitting diodes D1 to D8 from the SG terminal. More specifically, the control logic circuit 3 sets the SG terminal voltage to low level (i.e. a logic level when waiting for starting current supply) during the operation unstable period of the transistors Q1 to Q8, and raises the SG terminal voltage from low level to high level (i.e. a logic level when canceling waiting for current supply) after the operation unstable period of the transistors Q1 to Q8 elapses.

With this structure, because the drive current is not output from the driving circuit 1 during the operation unstable period of the transistors Q1 to Q8, it is possible to avoid instantaneous lighting of the light emitting diodes D1 to D8.

When abnormality such as overheat or short circuit is detected, the control logic circuit 3 sets a FAIL terminal voltage to a logic level when abnormality is detected (e.g. low level). Therefore, the lighted element number control IC 2 should include an abnormality detection portion that detects abnormality such as overheat or short circuit. Note that the lighted element number control IC 2 may be provided with a FAIL terminal dedicated to detection of overheat (overheat detection terminal) or a FAIL terminal dedicated to detection of short circuit (short circuit detection terminal), for example. The FAIL terminal dedicated to detection of overheat (overheat detection terminal) and the FAIL terminal dedicated to detection of short circuit (short circuit detection terminal) may be disposed together with a FAIL terminal for detection of a general abnormality (at least one of abnormalities such as overheat and short circuit).

The FAIL terminal voltage can be used for the limp-home control, for example. On the other hand, it is possible to adopt a specification in which the output from the driving circuit 1 is stopped when an abnormality is detected. In this example, the SG terminal and the FAIL terminal are adjacent to each other. Therefore, it is easy to connect the SG terminal and the FAIL terminal as illustrated in FIG. 25 by a dot line. By this connection between the SG terminal and the FAIL terminal, it is possible to adopt the specification in which the output from the driving circuit 1 is stopped when an abnormality is detected.

<Application>

Figure 5:
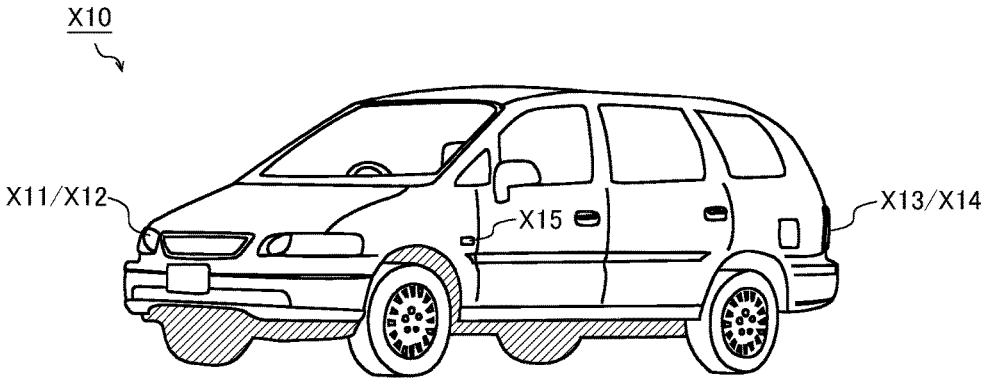
FIG. 5 is an external view (front) of a vehicle in which the light emitting device is mounted.
Figure 6:
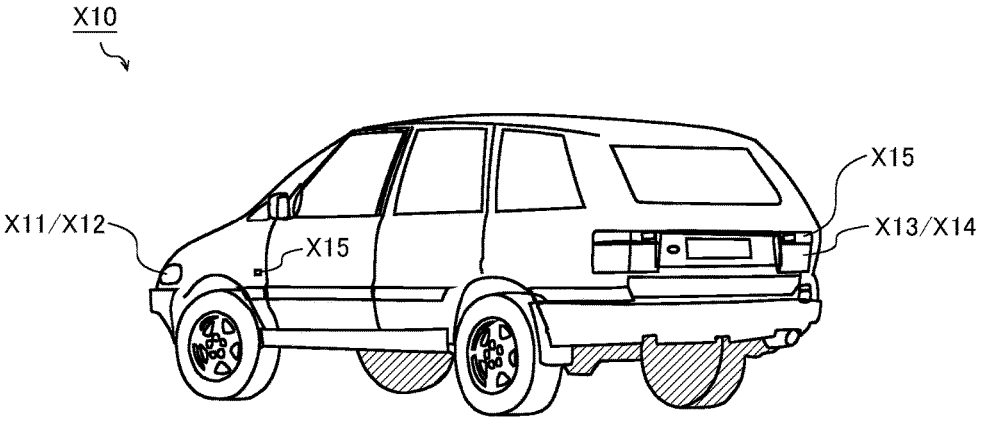
FIG. 6 is an external view (rear) of the vehicle in which the light emitting device is mounted.

The light emitting device described above can be used appropriately as illustrated in FIGS. 5 and 6, for example, as a headlight of a vehicle X10 (appropriately including a high beam, a low beam, a small lamp, a fog lamp, or the like) X11, a day and night running (DRL) light source X12, a tail lamp (appropriately including a small lamp, a back lamp, or the like) X13, a stop lamp X14, a turn lamp X15, or the like.

Figure 7:
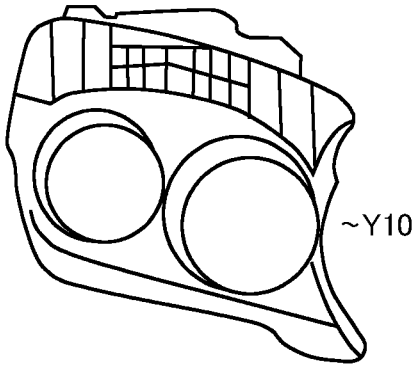
FIG. 7 is an external view of an LED headlight module.
Figure 8:
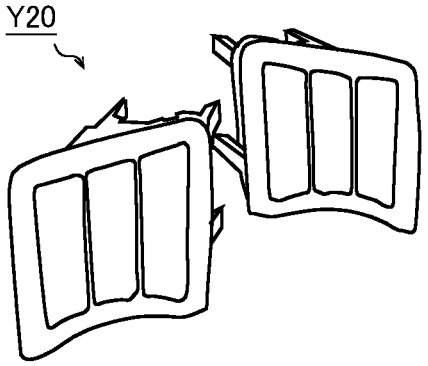
FIG. 8 is an external view of an LED turn lamp module.
Figure 9:
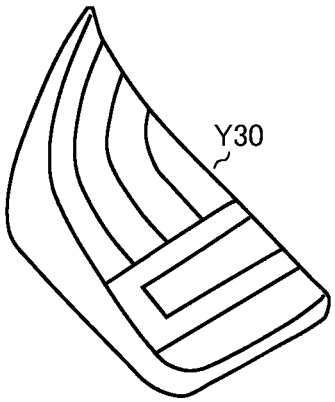
FIG. 9 is an external view of an LED rear lamp module.

Note that the light emitting device described above may be provided as a module (such as an LED head light module Y10 of FIG. 7, an LED turn lamp module Y20 of FIG. 8, or an LED rear lamp module Y30 of FIG. 9). In addition, it may be provided as a driving device having a function of controlling the number of light emitting elements, which is a semifinished product in which the light emitting diodes D1 to D8 and the external components of the driving circuit 1 are eliminated from the light emitting device described above.

In addition, the light emitting device described above can be used as a backlight of a display device, for example.

<Other Variations>

Note that the embodiment described above exemplifies the structure in which the light emitting diode is used as the light emitting element, but the present invention is not limited to this structure. For example, it is possible to use an organic electro-luminescence (EL) element as the light emitting element. For example, the ninth structural example and the tenth structural example may be combined for implementation, or other combination of a plurality of structural examples may be possible.

In addition, other than the embodiment described above, various technical features disclosed in this specification can be variously modified within the scope without deviating from the spirit of the technical invention. For example, it is possible to remove the transistors Q1 to Q8 from the lighted element number control IC 2, and to put the transistors Q1 to Q8 and the lighted element number control IC 2 without the transistors Q1 to Q8 in separate semiconductor packages. In addition, for example, it is possible to remove the transistors Q1 to Q8 from the lighted element number control IC 2, and put the transistors Q1 to Q8 and the light emitting diodes D1 to D8 in a module. In addition, for example, it is possible to dispose a voltage divider circuit that divides the anode voltage of the series connection unit constituted of the light emitting diodes D1 to D8 (anode voltage of the light emitting diode D1), so as to supply an output of the voltage divider circuit to a noninverting input terminal of the comparator 6. In this case, the reference voltage $V_{REF}$ should have a value obtained by multiplying a set value in the embodiment described above by a voltage division ratio of the voltage divider circuit. In other words, the embodiment described above is merely an example in every aspect and should not be interpreted as a limitation.

The technical scope of the present invention is defined not by the above description of the embodiment but by the claims, and should be understood to include all modifications within meaning and scope equivalent to the claims.

An example of the ground fault detection circuit described above detects a ground fault of a light emitting device including a series connection unit constituted of N light emitting elements (N is a natural number equal to or larger than two), a light emitting element driving circuit having an output terminal connected to an anode of the series connection unit, N short-circuit switches respectively connected in parallel to the light emitting elements, and a switch control unit arranged to control on and off of the short-circuit switches. The ground fault detection circuit includes an input portion to which an anode voltage of the series connection unit is input, and a ground fault determination unit arranged to determine that a ground fault has occurred without a short-circuit switch in the ground fault path, when the anode voltage of the series connection unit input through the input portion is equal to or smaller than a predetermined value that is smaller than the product of an on-resistance of one of the short-circuit switches and output current of the light emitting element driving circuit (first structure).

In addition, in the ground fault detection circuit of the first structure described above, the ground fault determination unit may include a reference voltage source arranged to generate a reference voltage having the predetermined value, and a comparator arranged to compare the anode voltage of the series connection unit with the reference voltage (second structure).

Another example of the ground fault detection circuit described above detects a ground fault of a light emitting device including a series connection unit constituted of N light emitting elements (N is a natural number equal to or larger than two), a light emitting element driving circuit having an output terminal connected to an anode of the series connection unit, N short-circuit switches respectively connected in parallel to the light emitting elements, and a switch control unit arranged to control on and off of the short-circuit switches. The ground fault detection circuit includes N short-circuit detection circuits arranged respectively to detect short-circuits in the light emitting elements, and a ground fault determination unit arranged to determine that a ground fault has occurred without a short-circuit switch in the ground fault path, if all the N short-circuit detection circuits detect that short-circuits have occurred in all the N light emitting elements when the switch control unit makes all the N short-circuit switches be in off state (third structure).

An example of the abnormality detection circuit described above includes the ground fault detection circuit of the first or second structure, N short-circuit detection circuits arranged respectively to detect short-circuits in the light emitting elements, and a short-circuit determination unit arranged to determine that a short circuit has occurred, if at least one of the short-circuit detection circuits detects that a short circuit has occurred in the light emitting element when the switch control unit makes all the N short-circuit switches be in off state (fourth structure).

Another example of the abnormality detection circuit described above includes the ground fault detection circuit of the third structure, and a short-circuit determination unit arranged to determine that a short circuit has occurred, if at least one of the short-circuit detection circuits detects that a short circuit has occurred in the light emitting element when the switch control unit makes all the N short-circuit switches be in off state (fifth structure).

In addition, the abnormality detection circuit of the fourth or fifth structure may further include a signal generation unit arranged to generate an abnormality detection signal based on an output signal of the ground fault determination unit and an output signal of the short-circuit determination unit, and may have a structure in which the signal generation unit generates the abnormality detection signals having different waveforms between a case where the output signal of the ground fault determination unit is a signal indicating a ground fault without a short-circuit switch in the ground fault path, and a case where the output signal of the ground fault determination unit is not the signal indicating a ground fault without a short-circuit switch in the ground fault path while the output signal of the short-circuit determination unit is a signal indicating a short-circuit (sixth structure).

The light emitting device described above includes the ground fault detection circuit having one of the first to third structures or the abnormality detection circuit having one of the fourth to sixth structures, a series connection unit constituted of N light emitting elements (N is a natural number equal to or larger than two), a light emitting element driving circuit having an output terminal connected to an anode of the series connection unit, N short-circuit switches respectively connected in parallel to the light emitting elements, and a switch control unit arranged to control on and off of the short-circuit switches (seventh structure).

In addition, in the light emitting device of the seventh structure, the light emitting element may be a light emitting diode or an organic EL element (eighth structure).

In addition, in the light emitting device of the seventh or eighth structure, the light emitting device may be used as an in-vehicle lamp (ninth structure).

In addition, in the light emitting device of the ninth structure, the light emitting device may be mounted in a vehicle as a headlight module, a turn lamp module, or a rear lamp module (tenth structure).

The vehicle described above includes the light emitting device of the ninth or tenth structure (eleventh structure).

In addition, in the vehicle of the eleventh structure, the light emitting device may be used as at least one of a headlight, a day and night running light source, a tail lamp, a stop lamp, and a turn lamp (twelfth structure).

What is claimed is:

1. A ground fault detection circuit comprising:

an input portion to which an anode voltage of a series connection unit constituted of a plurality of light emission elements is input; and a ground fault determination unit arranged to determine that a ground fault has occurred without a short-circuit switch in a ground fault path, when the anode voltage of the series connection unit input through the input portion is lower than or equal to a predetermined value less than a product of an on-resistance of the short-circuit switch disposed in parallel to each of the light emission elements and current supplied to the series connection unit.

2. An abnormality detection circuit comprising:

the ground fault detection circuit according to claim 1;

a plurality of short-circuit detection circuits each of which detects short circuit of the light emission element.

* * * * *